US010679529B1

(12) United States Patent
Wicken et al.

(10) Patent No.: US 10,679,529 B1
(45) Date of Patent: Jun. 9, 2020

(54) MODULAR POLE DISPLAY ASSEMBLY

(71) Applicant: Balloon Innovations Inc., Westminster, CO (US)

(72) Inventors: Christopher J. Wicken, Golden, CO (US); Gregg A. Wicken, Boulder, CO (US)

(73) Assignee: BALLOON INNOVATIONS INC., Westminster, CO (US)

( * ) Notice: Subject to any disclaimer, the term of this patent is extended or adjusted under 35 U.S.C. 154(b) by 389 days.

(21) Appl. No.: 15/436,062

(22) Filed: Feb. 17, 2017

Related U.S. Application Data

(60) Provisional application No. 62/296,854, filed on Feb. 18, 2016.

(51) Int. Cl.

| | |
|---|---|
| ***G09F 17/00*** | (2006.01) |
| ***G09F 7/18*** | (2006.01) |
| ***G09F 15/00*** | (2006.01) |
| ***G09F 7/22*** | (2006.01) |

(52) U.S. Cl.
CPC ..... *G09F 17/00* (2013.01); *G09F 7/18* (2013.01); *G09F 15/0018* (2013.01); *G09F 15/0037* (2013.01); *G09F 7/22* (2013.01); *G09F 2007/183* (2013.01); *G09F 2007/1813* (2013.01); *G09F 2007/1817* (2013.01); *G09F 2017/0025* (2013.01)

(58) Field of Classification Search
CPC ..... G09F 17/00; G09F 7/18; G09F 15/0018; G09F 15/0037; G09F 2007/183; G09F 7/22; G09F 2007/1813; G09F 2007/1817; G09F 2017/0025
USPC ..... 116/173–175
See application file for complete search history.

(56) References Cited

U.S. PATENT DOCUMENTS

| | | | | |
|---|---|---|---|---|
| 262,517 | A | 8/1882 | Unz | |
| 1,527,046 | A | 10/1922 | Ingram | |
| 1,512,831 | A | 10/1924 | Dunnell | |
| 1,535,396 | A | 4/1925 | Buehler | |
| 1,648,338 | A | 11/1927 | Gains | |
| 1,677,379 | A | 7/1928 | Ames | |
| 1,782,070 | A | 11/1930 | Lazarus | |
| 1,788,157 | A | 1/1931 | Hogan | |
| 1,855,824 | A * | 4/1932 | Crichton | E04H 12/32 116/173 |
| 2,143,691 | A | 4/1938 | Goldberg et al. | |

(Continued)

FOREIGN PATENT DOCUMENTS

WO 2015195981 A1 12/2015

OTHER PUBLICATIONS

Balloons Everywhere, Everyday Catalog & Buyers Guide. Wholesale Balloons & Floral Accessories- © 2007, 2008 Balloons Are Everywhere, Inc. 10 pages.

*Primary Examiner* — Nimeshkumar D Patel
*Assistant Examiner* — Tania Courson
(74) *Attorney, Agent, or Firm* — Berg Hill Greenleaf Ruscitti LLP

(57) ABSTRACT

The invention describes a modular display assembly that may be coupled with a pole or other structure or surface, and secured at an elevated position to be more easily viewed by potential consumers. The assembly may be modular in nature allowing it to support and display one or more customized advertising or marketing displays such as signs, flags and/or helium-free balloons as well as various support apparatus for the same.

20 Claims, 38 Drawing Sheets

(56) References Cited

U.S. PATENT DOCUMENTS 2,209,875 A 7/1940 Eichelsdoerfer
2,488,396 A 11/1949 Gottholm
2,664,667 A 1/1954 Burroughs
2,840,948 A 7/1958 Stickley
2,922,252 A 1/1960 Van Dam Albert
2,924,041 A 2/1960 Jackson
3,150,460 A 9/1964 Dees
3,162,409 A 12/1964 Straayer
3,192,568 A 7/1965 Nicholls
3,366,999 A 2/1968 Darby
3,439,079 A 4/1969 McDowell
3,892,081 A 11/1975 Goral
3,920,207 A 11/1975 Adamaitis
4,035,462 A 7/1977 Lane, Jr.
4,095,360 A * 6/1978 Dinan ..... G09F 7/22 40/603
4,542,445 A 9/1985 Marietta
4,589,854 A 5/1986 Smith
4,712,510 A 12/1987 Tae-Ho
4,794,498 A 12/1988 Neumeier
4,880,195 A * 11/1989 Lepley ..... G09F 17/00 248/219.4
4,895,545 A 1/1990 Nelson et al.
4,953,713 A 9/1990 Yaffe
5,027,992 A 7/1991 Murray
5,036,985 A 8/1991 Lovik
5,052,733 A 10/1991 Cheung et al.
5,127,867 A 7/1992 Lau
5,188,332 A 2/1993 Callas
5,203,530 A 4/1993 Liu
5,234,726 A 8/1993 Dahan
5,282,768 A 2/1994 Akman
5,564,575 A 10/1996 Casement
5,575,470 A 11/1996 Sherman
5,746,461 A 5/1998 Broberg
5,769,474 A 6/1998 Moore
5,823,365 A 10/1998 Page
5,873,764 A 2/1999 Scherr
5,938,255 A 8/1999 Rose et al.
5,944,576 A 8/1999 Nelson et al.
6,176,758 B1 1/2001 Wu
6,273,479 B1 8/2001 Carlson
6,378,820 B1 4/2002 Mooney et al.
6,422,914 B1 7/2002 Nelson
6,478,057 B1 11/2002 Bearss et al.
6,478,651 B1 11/2002 Weir
6,745,904 B1 6/2004 Komar
6,923,141 B1 8/2005 Staats
6,935,268 B1 8/2005 Hawkins
6,938,871 B1 9/2005 Carlson
6,969,295 B1 11/2005 Sidwell
D517,123 S 3/2006 Sidwell
7,017,511 B2 3/2006 Fisher
7,249,991 B1 7/2007 Watson
7,588,477 B2 9/2009 Sidwell
7,611,395 B2 11/2009 Bonsembiante
D610,208 S 2/2010 Hou
7,810,265 B2 10/2010 Beatty
7,854,642 B2 12/2010 Nelson et al.
7,922,116 B2 4/2011 Nguyen
7,967,344 B2 6/2011 Herren
8,152,588 B2 4/2012 Hua
D659,200 S 5/2012 Wicken
8,297,216 B1 * 10/2012 Janton ..... G09F 17/00 116/173
8,544,407 B2 10/2013 Spray
8,789,565 B1 7/2014 Wicken
8,840,440 B2 9/2014 Pierce
8,968,047 B1 3/2015 Wicken
9,087,462 B1 7/2015 Gallus
9,132,595 B1 9/2015 Wicken et al.
9,399,176 B1 * 7/2016 Wicken ..... A63H 27/10
9,809,784 B2 11/2017 Wang et al.
9,855,511 B2 * 1/2018 Wicken ..... A63H 27/10
2001/0045074 A1 11/2001 Kim
2003/0071185 A1 4/2003 Casapulla
2004/0077268 A1 4/2004 Wainohu
2006/0011793 A1 1/2006 Dupuis et al.
2006/0289707 A1 12/2006 Greenwald et al.
2006/0292960 A1 12/2006 Muller
2007/0007424 A1 1/2007 Sifferlin et al.
2007/0049158 A1 3/2007 Chou
2007/0218802 A1 9/2007 Gronethal
2007/0256341 A1 * 11/2007 McLaughlin ..... G09F 7/18 40/607.13
2008/0121309 A1 5/2008 Boise et al.
2008/0166942 A1 7/2008 Hou
2008/0166943 A1 7/2008 Hou
2009/0146029 A1 * 6/2009 Beatty ..... G09F 7/18 248/206.5
2009/0197502 A1 8/2009 Nelson et al.
2009/0296372 A1 12/2009 Schrimmer
2010/0018095 A1 * 1/2010 Molla ..... G09F 7/22 40/606.16
2011/0240823 A1 10/2011 Hua
2011/0253876 A1 10/2011 Odell
2011/0290171 A1 12/2011 Brick
2012/0015581 A1 1/2012 Feldstein
2012/0211614 A1 8/2012 Parello et al.
2014/0096867 A1 4/2014 Cayton
2016/0189578 A1 6/2016 Wicken
2016/0214023 A1 7/2016 Wicken
2016/0220917 A1 8/2016 Wicken
2017/0144077 A1 * 5/2017 Wicken ..... A63H 27/10
2017/0287372 A1 * 10/2017 Ashworth ..... G09F 7/18
2019/0279542 A1 * 9/2019 Wicken ..... G09F 17/00

* cited by examiner

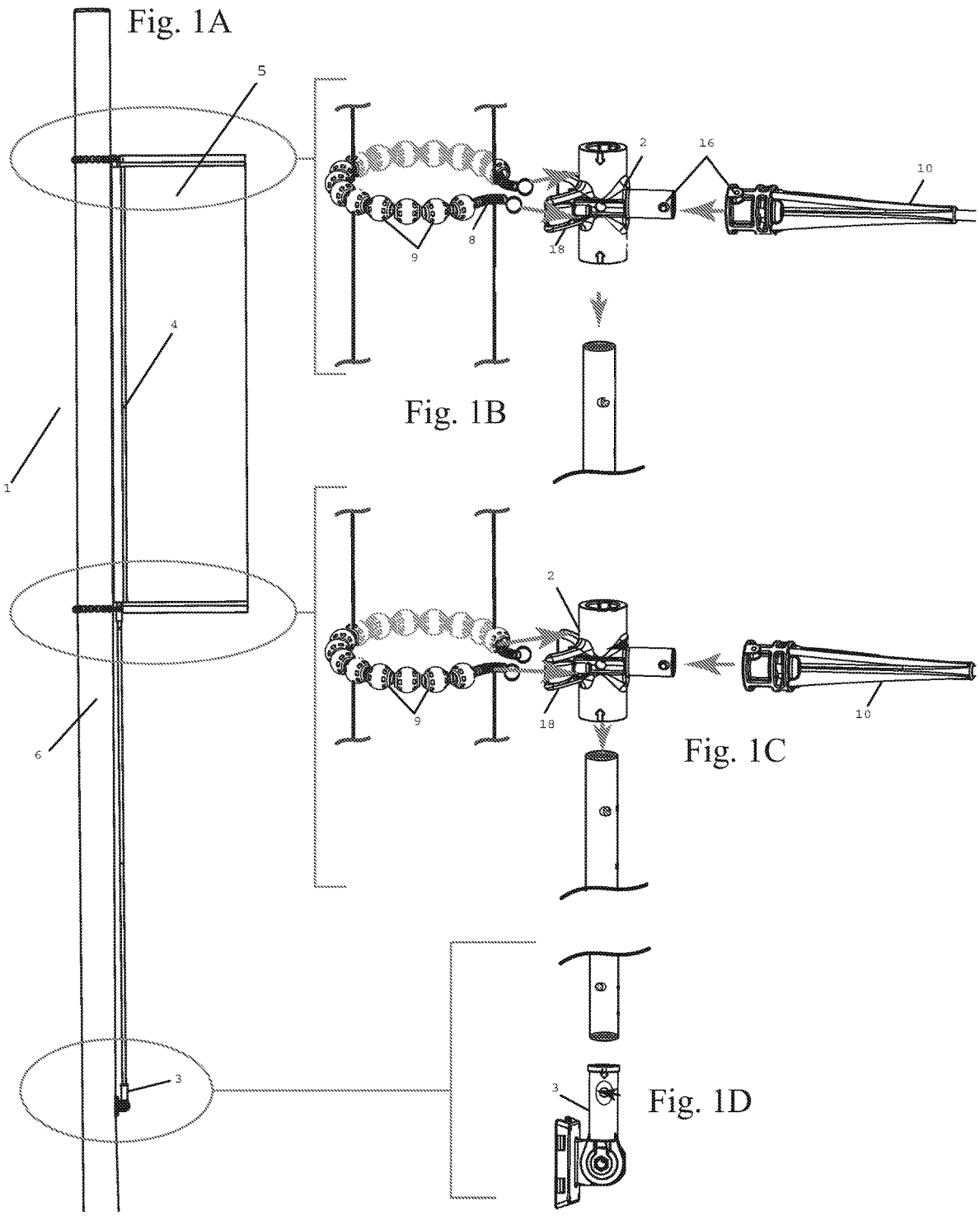
Fig. 1A-D

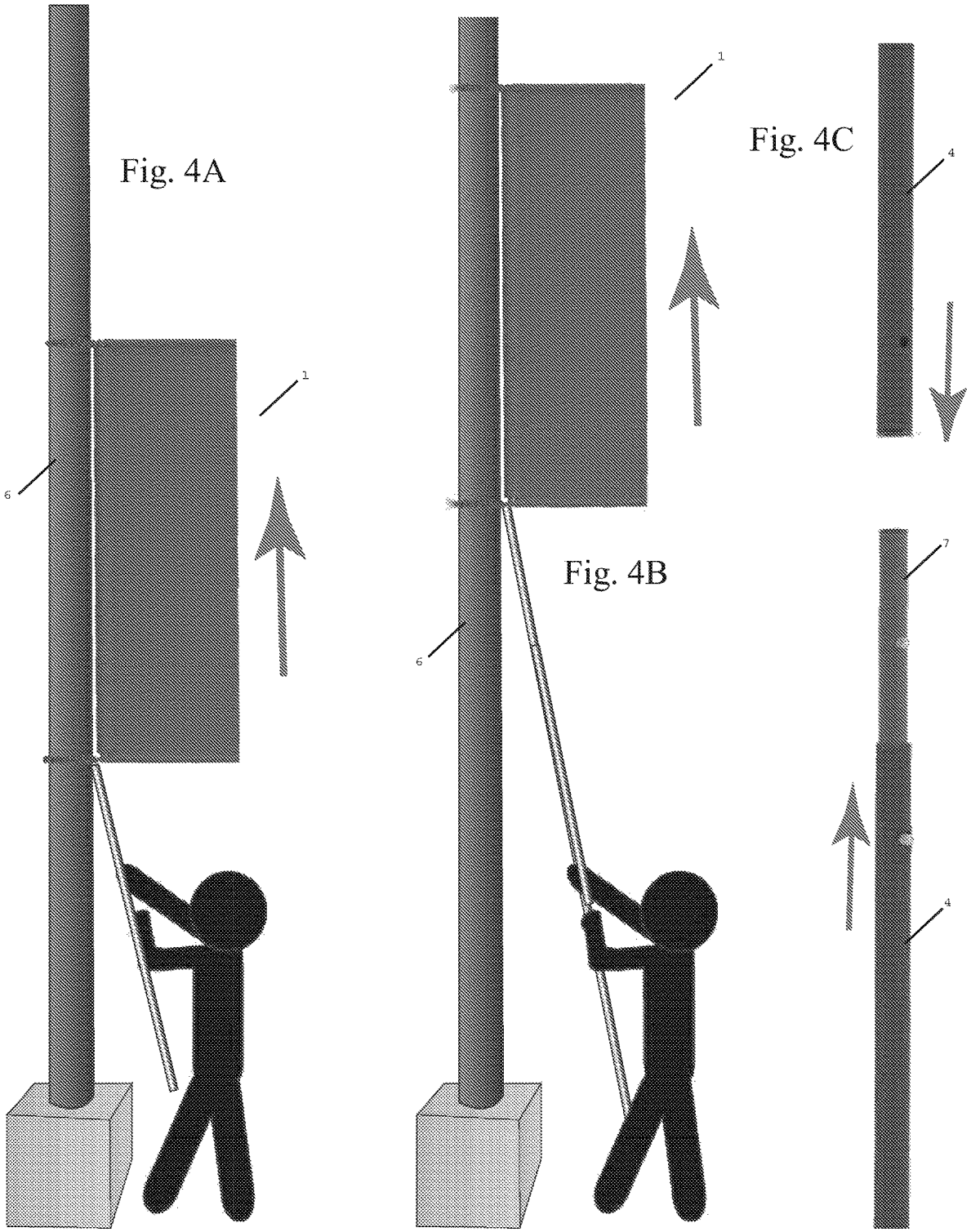
Fig. 4A-C

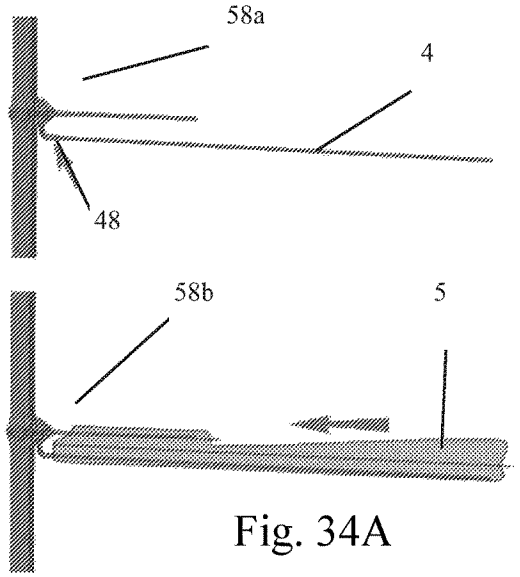
Fig. 34A
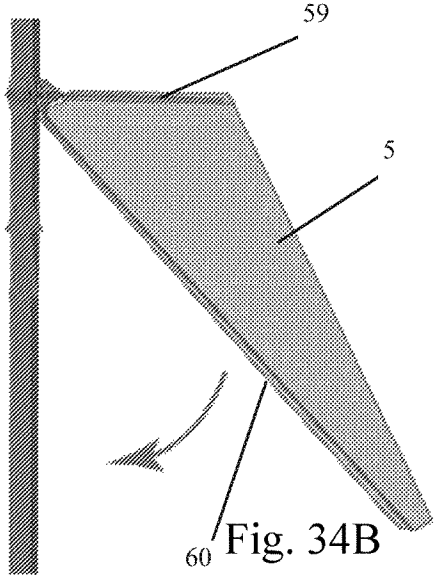
Fig. 34B
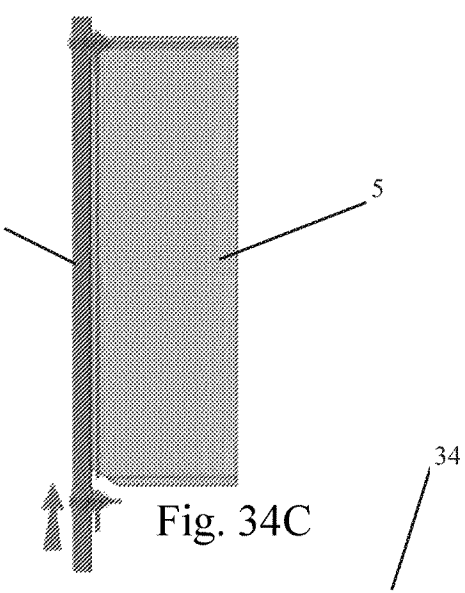
Fig. 34C
Fig. 34D
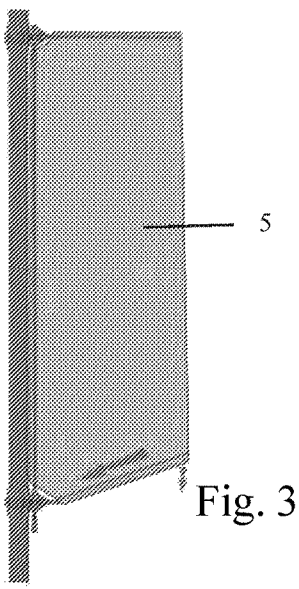
Fig. 34E
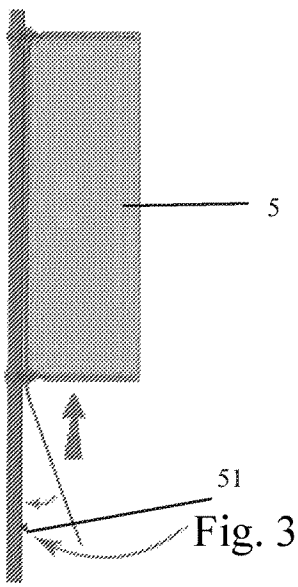
Fig. 34F
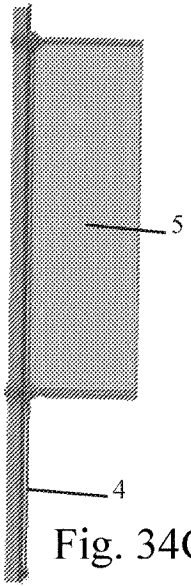
Fig. 34G

MODULAR POLE DISPLAY ASSEMBLY

This application claims the benefit of and priority to U.S. Provisional Application No. 62/296,854 filed Feb. 18, 2016. The entire specification and figures of the above-mentioned applications are hereby incorporated in their entirety by reference.

TECHNICAL FIELD

Generally, the inventive technology disclosed herein relates to a novel and unique modular display assembly. In a preferred embodiment, the invention may be used to position and support, for example, a display, such as a flag, balloon, or other marketing/advertising signs on a stationary pole or other external surface/structure. In another preferred embodiment, one or more modular display assemblies may be secured to a pole or other external surface at the level of a typical user and moved to, and secured in an elevated position without the need for a ladder and/or lift.

BACKGROUND OF THE INVENTION

Traditional marketing displays, such as flags, are often placed in elevated positions to both generate a clear line of sight to potential consumers, as well as to make use of generally empty space thus maximizing the display's commercial impact without impeding the flow of consumers. Such traditional marketing displays, such as signage, flags, balloons, and even artistic presentations are often secured in elevated positions through simple supports, or simply being manually secured to existing structures. However, such traditional displays require a ladder or lift to allow them to be positioned at the desired elevations. In addition, traditional displays employ static and/or rigid display components which may break or become impractical in high wind or other adverse conditions. Moreover, traditional display systems are difficult to position at elevated positions, and often require components to be permanently affixed, or affixed through screws and other similar means. Naturally, placement of such permanent components can be impracticable for metal structures such as stationary poles and the like. In addition, non-permeant couplings may lose their ability to support the display over time and require additional tightening or other maintenance, again typically requiring a user to use a ladder or other lift to reach the elevated position. This situation is not only impractical but potentially dangerous.

It is the object of the present invention to provide a modular display assembly to address the comprehensive concerns outlined above. One object of the current invention may be to provide a modular display assembly that may be secured to a pole or other external surface and elevated by a user to a desired height without the need of a ladder or lift. Another object of the current invention may also be to provide a modular pole flag display assembly that may allow lateral or other tractable movement of a supported display flag allowing it to remain in an elevated position even during high wind conditions. Another object of the current invention may also be to provide a quick-release assembly that may be used to quick couple and de-couple the assembly from a pole or other external surface/structure. Another object of the current invention may be to provide an assembly having a rotational element that may allow it to more easily slide along the length of a pole or other external surface. Additional objects of the present invention will become apparent through the detailed explanation below.

BRIEF DESCRIPTION OF THE DRAWINGS

FIG. 1A: is a flag assembly having a single flag in one embodiment thereof;

FIG. 1B: is a first pole bracket assembly in one embodiment thereof;

FIG. 1C: is a second pole bracket assembly in one embodiment thereof;

FIG. 1D: is an adjustable joint coupler in one embodiment thereof;

FIG. 4A: is a representative description of a user elevating a flag pole assembly utilizing an installation rod in one embodiment thereof;

FIG. 4B: is a representative description of a user elevating a flag pole assembly utilizing an installation rod in one embodiment thereof;

FIG. 4C: are two supporting installation rods being coupled in one embodiment thereof;

FIG. 33C: demonstrates a part of a stepwise method of assembling a single modular pole flag display assembly in one embodiment thereof;

FIG. 34A: demonstrates a part of a stepwise method of assembling a modular pole display assembly to support at least one flag in one embodiment thereof;

FIG. 34B: demonstrates a part of a stepwise method of assembling a modular pole display assembly to support at least one flag in one embodiment thereof;

FIG. 34C: demonstrates a part of a stepwise method of assembling a modular pole display assembly to support at least one flag in one embodiment thereof;

FIG. 34D: demonstrates a part of a stepwise method of assembling a modular pole display assembly to support at least one flag in one embodiment thereof;

FIG. 34E: demonstrates a part of a stepwise method of assembling a modular pole display assembly to support at least one flag in one embodiment thereof;

FIG. 34F demonstrates a part of a stepwise method of assembling a modular pole display assembly to support at least one flag in one embodiment thereof;

DETAILED DESCRIPTION OF THE INVENTION

Figures 2A, 2B:
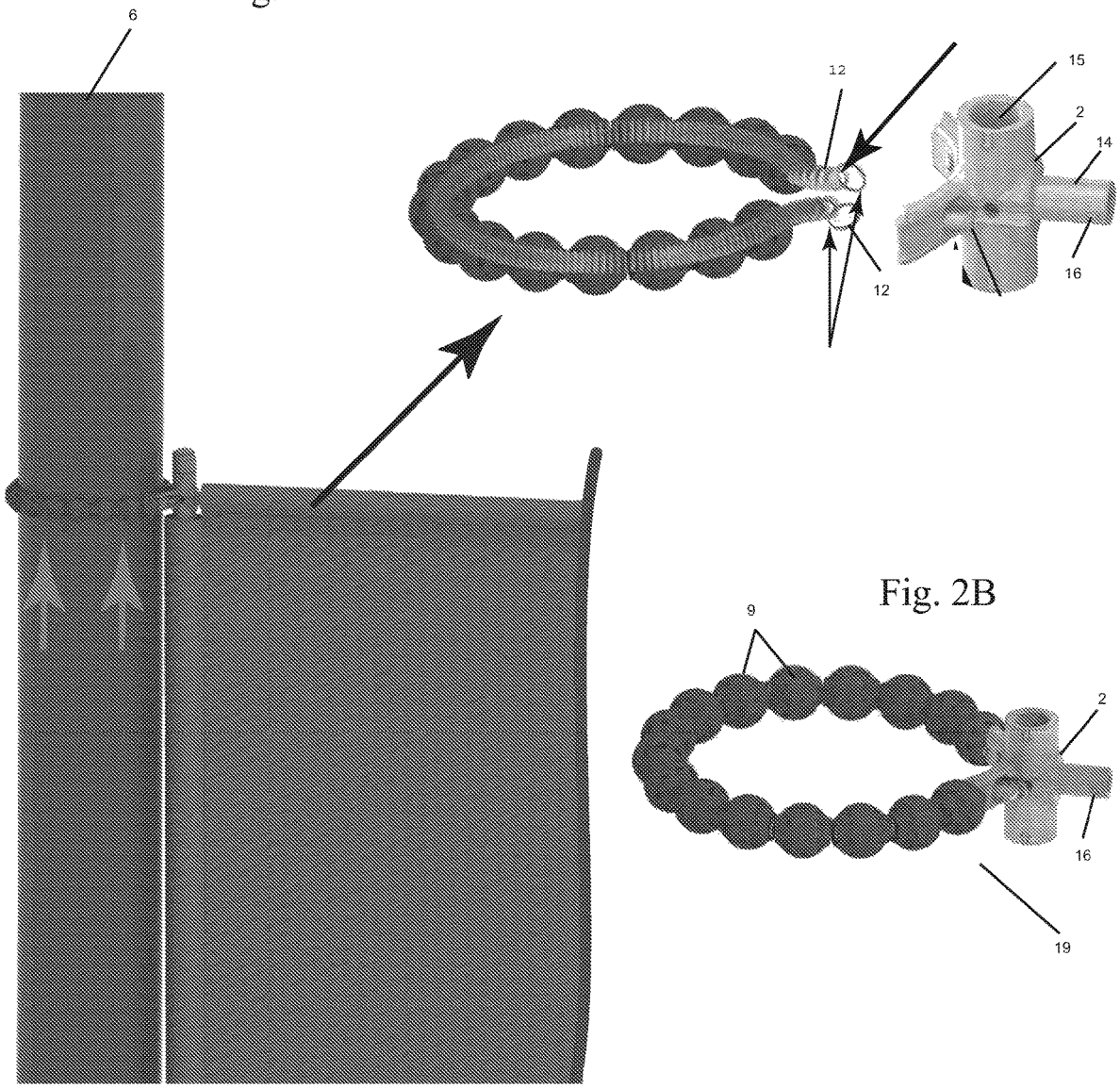
FIG. 2A: is a pole bracket with an uncoupled tension spring assembly in one embodiment thereof.
FIG. 2B: is a pole bracket assembly in one embodiment thereof.

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and with any and all various permutations and combinations of all elements in this or any subsequent application.

Generally referring to FIGS. 1A-D, in one embodiment the inventive technology may generally include a flag assembly (1). In one preferred embodiment, a flag assembly may be secured to a stationary object, such as a vertical pole or other appropriate surface. Referring now to the embodiment shown in FIG. 1B, the flag assembly may include one or more pole bracket(s) (2). In this preferred embodiment, the pole bracket (2) may include at least one pole attachment surface (18). As shown, this pole attachment surface (18) may include a curvilinear extension that may be approximately mated with the rounded surface of a corresponding pole (6). In one embodiment, this pole attachment surface (18) may form a frictional coupling with the surface of the pole, while in still other embodiment adhesive, magnet or suction coupling mechanisms may be used to secure the pole attachment surface (18) to the surface of a pole (6).

In various embodiments, a pole bracket (2) may be secured to a pole (6), or other surface, through one or more pole bracket couplers. As detailed in FIGS. 1B-C and 2A-B, in this preferred embodiment, a pole bracket (2) may be secured to the external surface of a pole (6) by one or more tension springs (8) As shown in the figures, in this embodiment a tension spring may include spring mounting loops (12) on either end that may be secured over corresponding spring mountings (13) on the pole bracket (2). In this manner, the tension spring (8) may be wrapped around the external surface of the pole (6) with the spring mounting loops (12) on either end secured over corresponding spring mountings (13) on the pole bracket (2), thereby securing it to the pole's surface. Naturally, in additional embodiments such tension springs (8) may include traditional coiled springs, as well as any material having the ability to stretch and/or provide sufficient tension to secure the pole bracket (2) to an external surface. Such tension springs (8) or other securement devices may further be adjustable to accommodate a variety of external surfaces as well as pole diameters.

Again, generally referring to FIGS. 2A-B, in this embodiment one or more rollers (9) may be positioned over a tension springs (8). In this configuration, when the pole bracket (2) is secured on the surface of a pole (6), the rollers (9) may be rotatable such that the bracket may slide along the length of the pole to be placed at a desired position. In some embodiments, the tension spring (8) may generally have sufficient tension to hold the pole bracket assembly (19) in place after being positioned, while in other embodiments the pole bracket assembly (19) may be supported by an external support or pole. It should be noted that in additional embodiments, a tension spring (8) or other securement component may be rotatable to be able to slide along the length of a stationary pole (6) and the like.

Again, referring to FIGS. 1-2, in one embodiment, one or more display supports (10) may be coupled with a pole bracket (2). In the preferred embodiment shown, a display support (10), in this case a fiberglass stem having an over molded turnkey handle, may be coupled with a pole bracket (2) through a lock (16). In this preferred embodiment, a flag, or other display such as a banner, balloon, balloon display, helium-free balloon and the like, may be coupled with, and/or supported by the display support (10). In the embodiment shown in FIG. 3, the fiberglass stem of a display support (10) may be inserted into a channel on the bottom and/or top leading edge of, in this case, a display flag or flag (5) securing it into a display position. Again, as shown in the figures, the display supports (10) may further be perpendicularly coupled to corresponding pole brackets (2) displaying the flag.

As detailed in FIGS. 1B-C and 2A-B, in one embodiment the pole bracket (2) may include one or more rod coupler(s) (15), in this case positioned along a vertical axis in relation to the pole bracket (2) body. In this preferred embodiment, a pole bracket assembly (19) may be coupled with one or more installation rods (4). As shown in FIGS. 1-3, in a preferred embodiment one or more pole bracket assemblies (19) may be secured to a stationary pole (6), which may further be coupled together through one or more installation rods (4). In the preferred embodiment shown, two pole bracket assemblies (19) may be coupled in series by an installation rod (4) secured in a rod coupler (15) on each pole bracket (2).

As generally shown through the subject figures, the installation rod (4) may be secured in a rod coupler (15) on each pole bracket (2) through a lock (16), such as a snap or twist lock mechanism. Such locking components are exemplary as multiple coupling components may be employed, such as a fitted coupler, a twist coupler, a beveled coupler, a ridged coupler, a magnetic coupler and the like. In addition, as generally shown in FIGS. 4A-C, in certain embodiments a plurality of installation rods (4) may be coupled together. In one embodiment, a rod coupler (7) maybe positioned internally within two installation rods (4) coupling them in series, for example through a button coupler. In other embodiments, the installation rods (4) may include coupler positions that may be interlocked one with another. Such rod couplers may include, but not be limited to fitted couplers, a twist coupler, a beveled coupler, a ridged coupler, a magnetic coupler and the like.

Figures 3A, 3B:
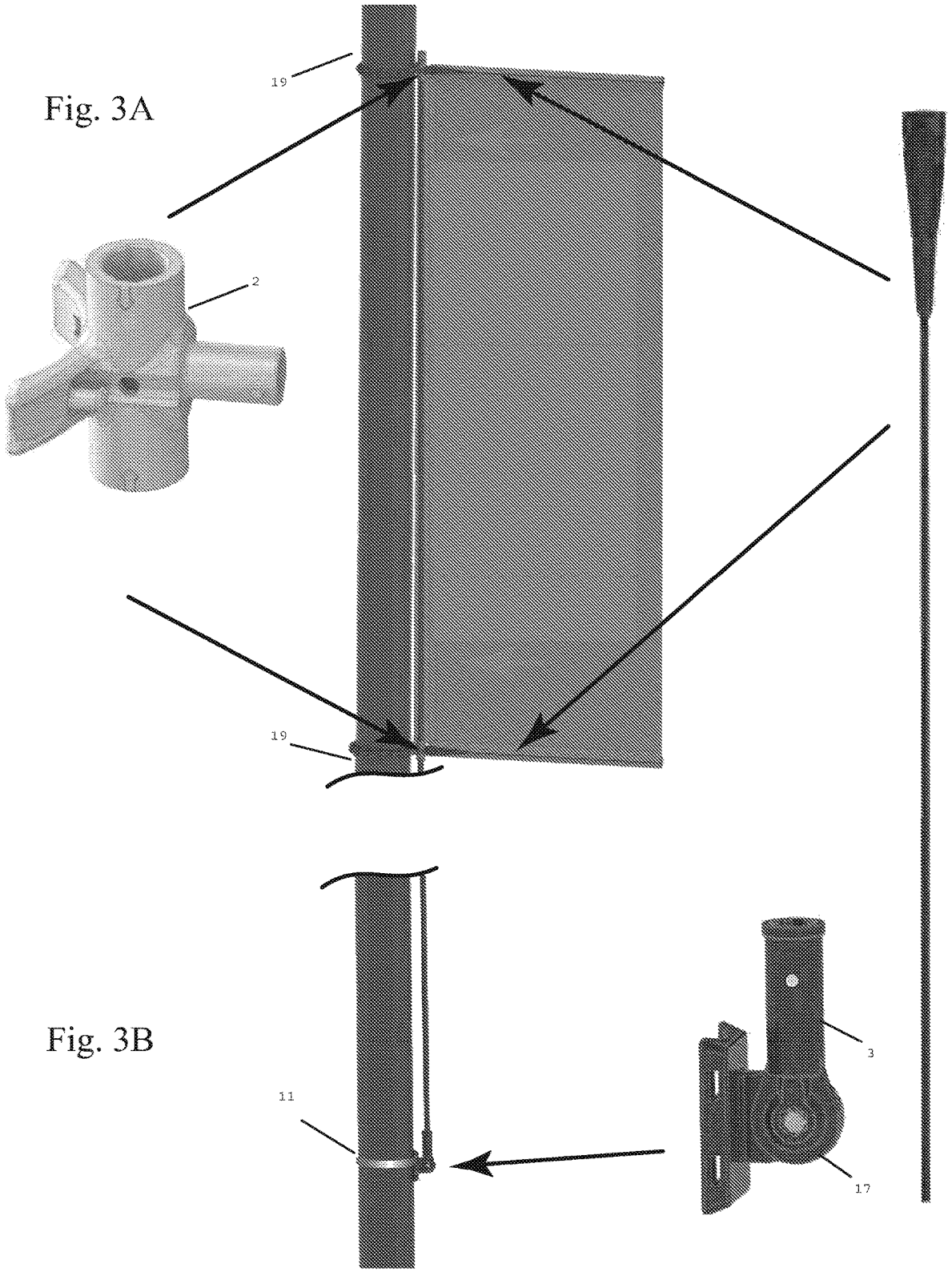
FIG. 3A: is a top portion of a single flag assembly showing isolated components in one embodiment thereof.
FIG. 3B: is a bottom portion of a single flag assembly showing an isolated adjustable joint coupler component in one embodiment thereof.

Generally referring to FIGS. 3A-B and 4, in one embodiment a user may elevate the assembly along the length of a pole (6) or other surface. In this preferred embodiment, a user may couple one or more installation rods (4) with a rod coupler (15) on a pole bracket (2) that may be secured to a pole (6). In this embodiment, the user may exert an upward force to push, in this case, two pole bracket assemblies (19) that are coupled together through at least one additional installation rod (4). The user's applied upward force may allow the rollers (9) to slide the coupled assemblies along the length of the stationary pole (6) to an elevated position. With the coupled pole bracket assemblies (19) and, in this instance, a display flag (5) placed in an elevated position, the elevating installation rod (4) may be coupled with an adjustable joint coupler (17).

As generally shown in FIGS. 3-4, in a preferred embodiment, an adjustable joint coupler (17) may be secured to the surface of a pole (6), for example, through a band clamp (11). The adjustable joint coupler (17) may be jointed to allow, for example multi-directional display of the display/flag assembly (1) as well as to assist with the insertion of a supporting installation rod (4) into the adjustable joint coupler (17). In a preferred embodiment, a supporting installation rod (4) may be coupled with adjustable joint coupler (17) through a lock (16), such as a snap-lock, twist lock or button-release lock and the like.

As generally shown in FIGS. 5-13, in one alternative embodiment the invention may include one or more modular pole clamp assemblies (20) coupled with at least one installation rod (4). In this embodiment, as shown in FIG. 1A, one or more modular pole clamp assemblies (20) may be secured to an external surface, such as a pole to display a flag (5), or other display, at an elevated position.

Figure 7:
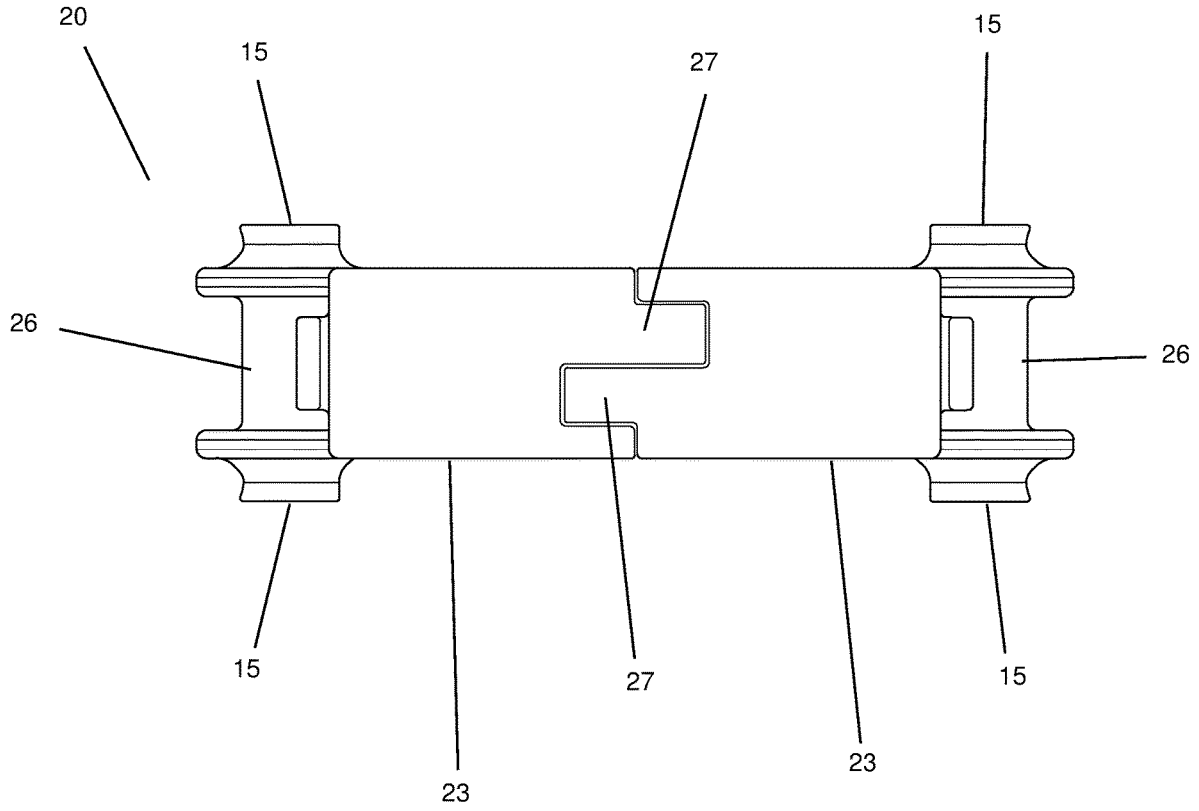
FIG. 7: is a side view of a clamp module in one embodiment thereof.
Figure 8:
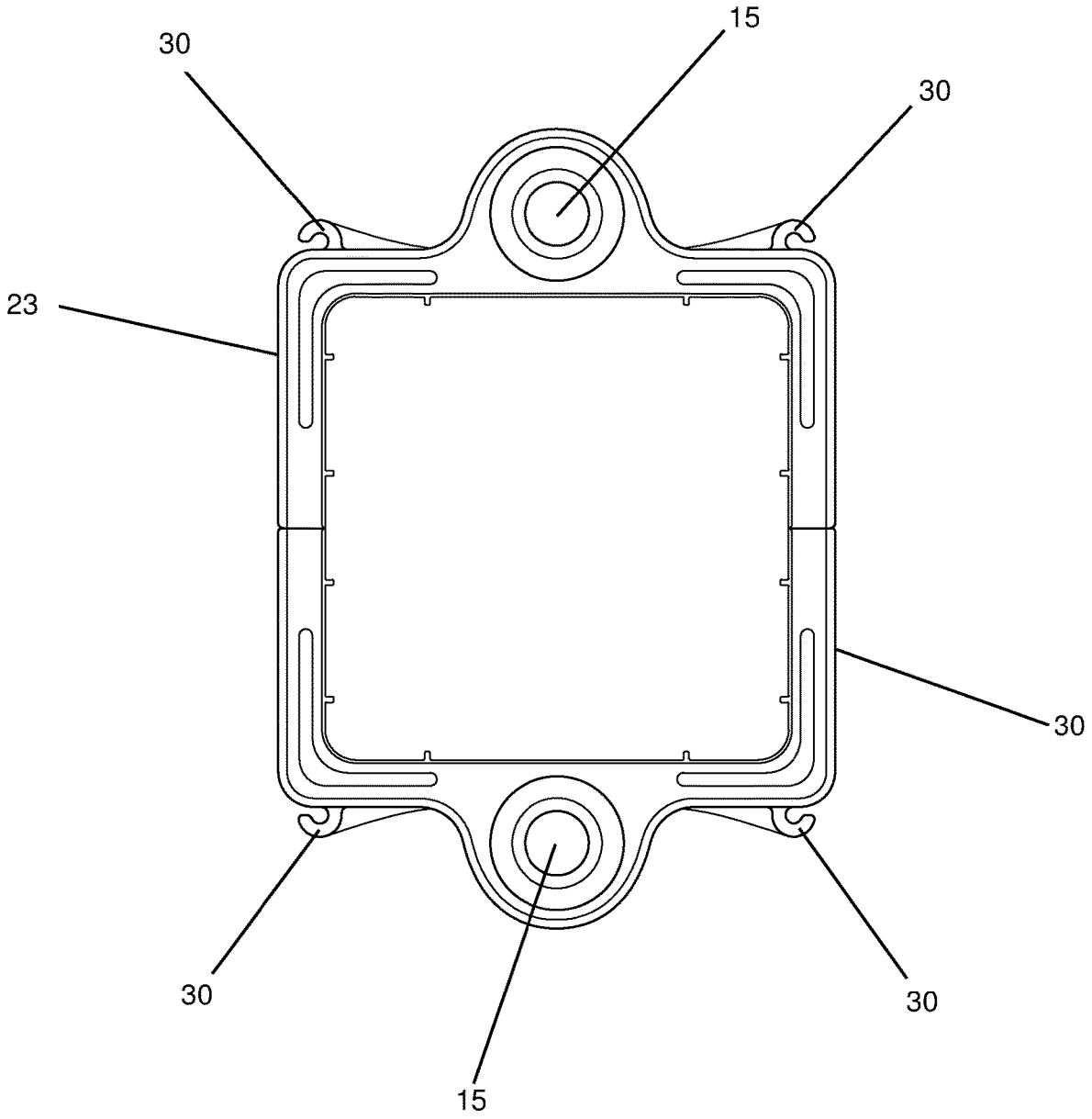
FIG. 8: is a top view of a clamp module in one embodiment thereof.
Figure 9:
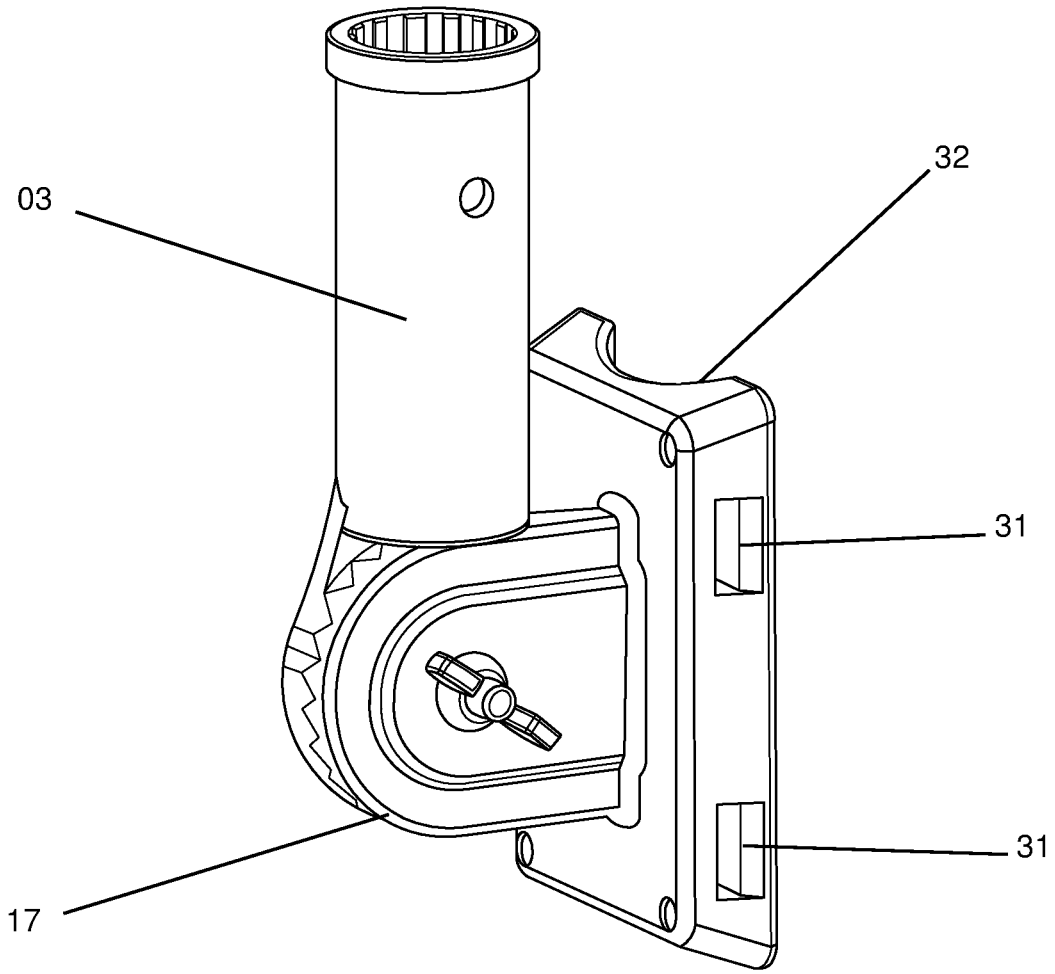
FIG. 9: is an adjustable joint coupler in one embodiment thereof.
Figure 10:
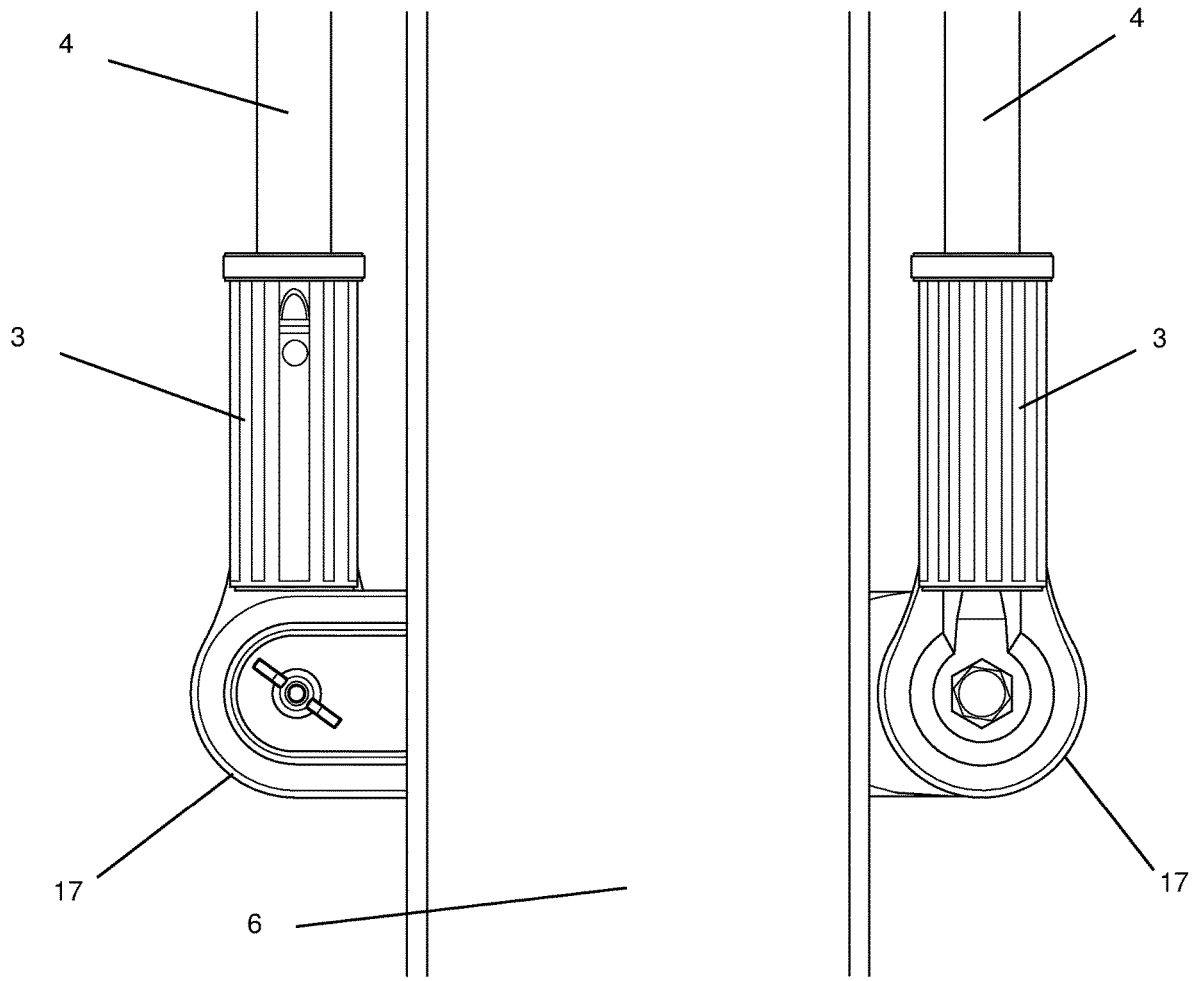
FIG. 10: are dual adjustable joint couplers secured to a pole in one embodiment thereof.

Specifically referring to FIGS. 6-13, in one preferred embodiment a modular pole clamp display assembly (20) may include a clamp module (23) that may be secured around a pole. As shown in FIGS. 7-9, in one embodiment, two corresponding clamp modules (23) may be coupled together, for example, through a snap lock (27) mechanism. As noted in the figures, when the corresponding clamp modules (23) are coupled together they may be secured to the external surface of a pole. For example, in FIGS. 7-8 and 13, in this preferred embodiment two clamp modules (23) are coupled together through opposing quick-release locks (33). In this embodiment, integral latches (33) may be flexed to disengage the snap lock mechanism (27) allowing for a quick-coupling/decoupling of the clamp modules (23) with one another.

It should be noted that in the embodiment demonstrated in the figures, the clamp modules (23) may form a substantially square shape, which would naturally correspond to a square pole. Such embodiment is exemplary, as a variety of sizes, shapes and diameters may be contemplated, such as triangular, or circular. Naturally, additional lock (16) configurations may be contemplated within the scope of the inventions, including but not limited to quick release locks, beveled locks, twist locks, button-hole locks and the like.

In other embodiments not shown, a clamp module (23) may include a single unitary component that may include a release and lock component to allow it to open, be placed around a stationary pole (6) and re-secured. Additional embodiments may include modular components that may be added to increase the size of the pole aperture created by one or more coupled clamp modules (23). It should also be noted that while the clamp module (23) shown in the figures may be manufactured of a hard plastic or other similar material, additional clamp module (23) embodiments may include flexible materials, such as a flexible band having a lock mechanism such that it can be wrapped around a pole and adjustably secured. Additional embodiments may include rolling elements along the interior surface of a clamp module (23) to facilitate movement of the clamp along the modular pole clamp display assembly (20) along the length of the pole. Still further embodiment may include a jointed clamp module (23) that may allow one or more clamp modules (23) to be adjustable to fit along a variety of surfaces.

Figure 11:
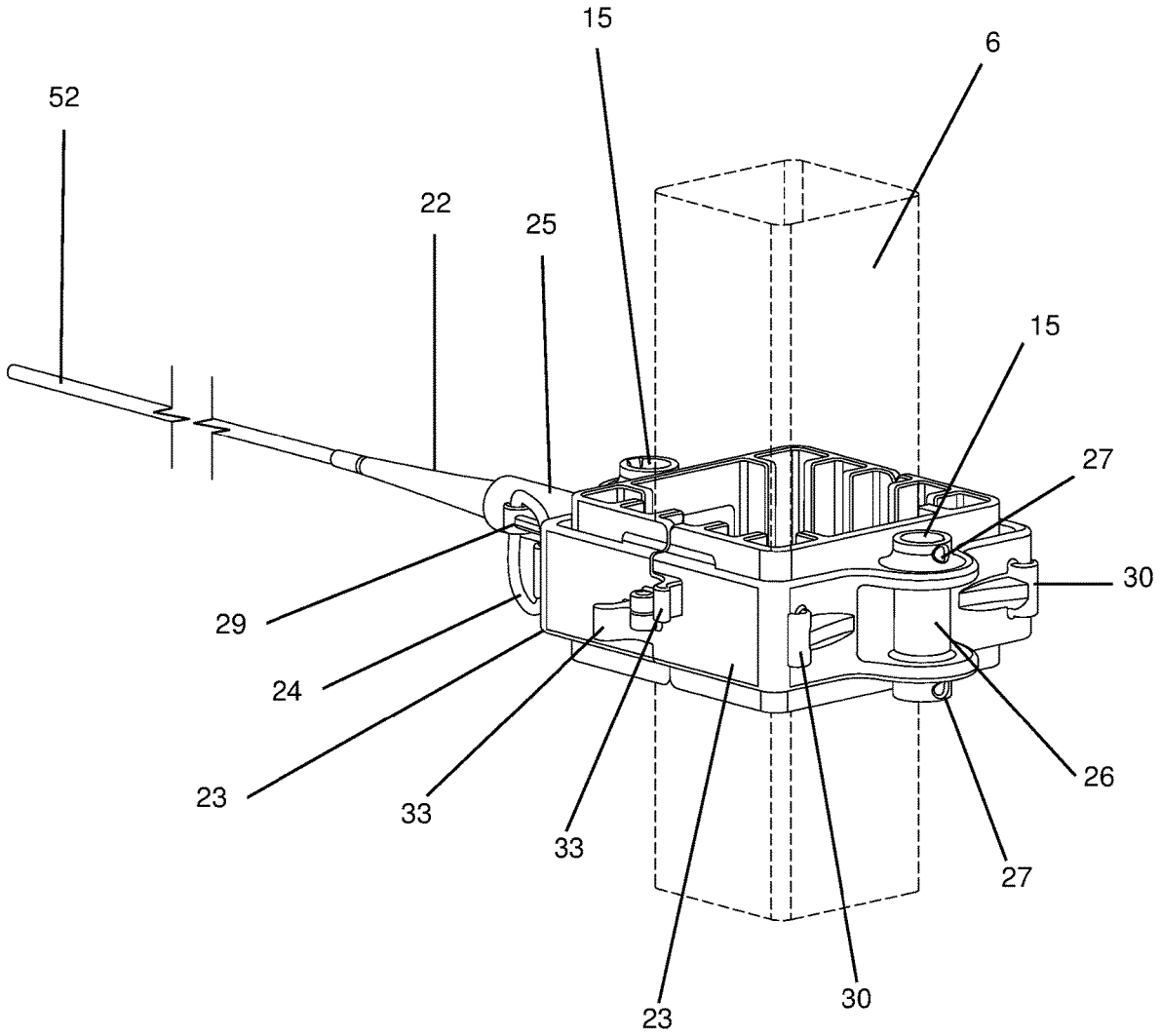
FIG. 11: is a modular pole display assembly coupled with a pole in one embodiment thereof.
Figure 12:
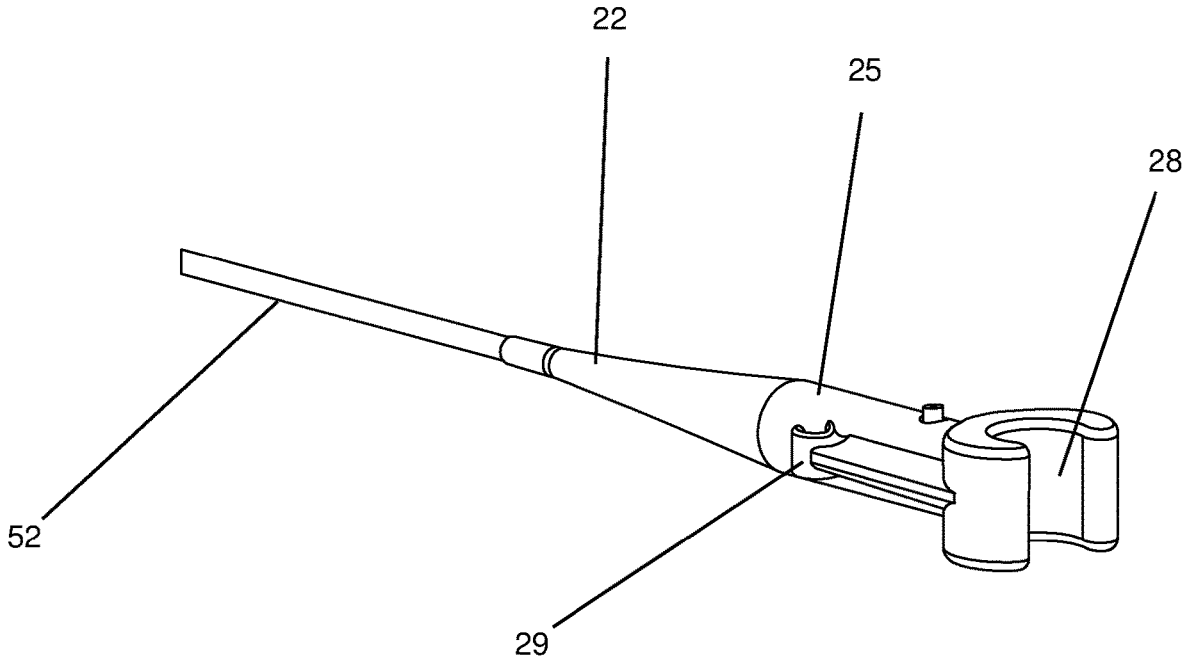
FIG. 12: is an isolated stem support in one embodiment thereof.
Figure 13:
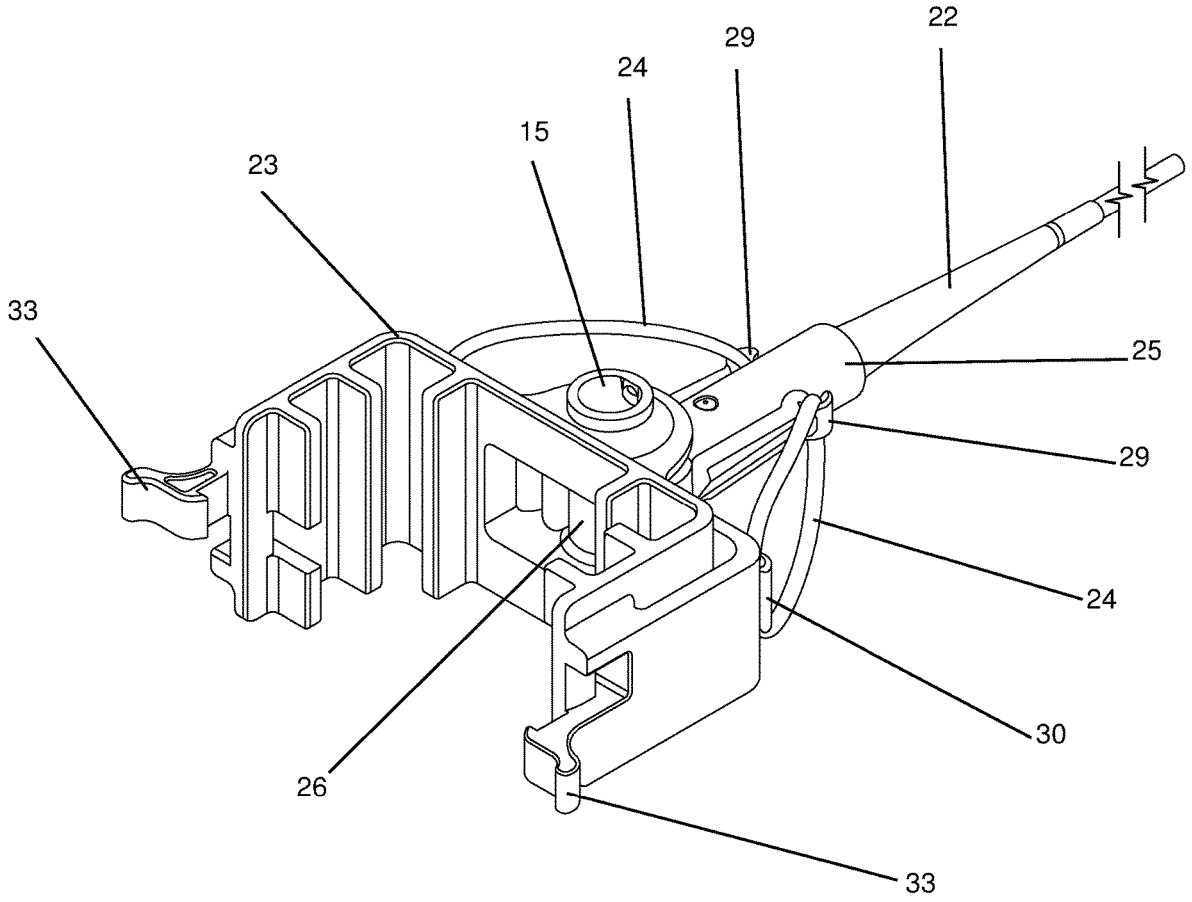
FIG. 13: is a partial modular pole display assembly having a single clamp module in one embodiment thereof.

Referring generally to FIG. 11, in one embodiment a clamp module (23) may include one or more stem support couplers (26). In this embodiment, this stem support coupler (26) may include an integral hollow tube positioned along the outside surface of the clamp module (23). In this configuration, a stem support (25) may be coupled with a stem support coupler (26), allowing it, in this embodiment, to extend perpendicularly with respect to a coupled pole. As shown in FIGS. 11-13, in one preferred embodiment a stem support (25) may include a coupler position (28) that may allow it to be coupled with a clamp module (23). A variety of coupler positions may be contemplated (such as snap, fitted, button-lock, twist as well as hinged coupler position) as within the scope of the invention.

In the preferred embodiment shown, the stem support (25) may include a circular fitted coupler position (28) that may be coupled with a stem support coupler (26) on the clamp module (23). This preferred configuration may allow lateral movement of the coupled stem support (25). This lateral movement may allow a corresponding flag or other display to also move laterally, for example, during windy conditions. Such configurations may be advantageous to allow the flag to remain in an elevated position during high-wind conditions while reducing stress placed on the stem support (25) and clamp module (23).

Another advantage of this lateral movement may include the ability to maintain a flag or other display without having to introduce wind-break holes in the flag to allow air to pass through. In addition, such a configuration may allow the stem support (25) to become detached from the clamp module (23) in severe wind conditions, and allow it to be re-coupled during low wind condition without breaking any corresponding components. As shown in FIG. 12, in one preferred embodiment the stem support (25) may include a band attachment (29). In this embodiment, a flexible band (24) may be secured by the band attachment (29) and further secured with a band attachment (30) on a clamp module (23). In their configuration, the coupling of the clamp module (23) and stem support (25) with a flexible band (24) may reinforce the coupling and limit the lateral movement of the stem support (25) during high wing conditions. This flexible coupling may also help prevent decoupling of the stem support (25) from the stem support coupler (26) while still allowing lateral movement. In addition, should the stem support (25) become decoupled from the stem support coupler (26), the flexible bands (24) may prevent the stem support (25) and corresponding flag from becoming completely dislodged from the assembly, potentially being lost or damaged from the fall.

Referring to FIGS. 1A-2B, in one embodiment, one or more support stems (22) may be coupled with stem supports (25). In one preferred embodiment, a support stem (22) may include a fiberglass or other semi-flexible rod coupled, perhaps through an over molded handle portion. In this embodiment, a stem support (25) maybe be inserted into a channel on the bottom and/or top leading edge of, in this case, a flag (5) securing it into a display position. (Naturally, additional stem support (25) configurations that may support a variety of displays are contemplated in this application). As shown in FIGS. 8-12 and 13, the other end of the support stem (22) may be coupled with the stem support (25), perhaps through a lock (16), such as a snap lock, twist lock, or button-hole lock and the like. Additional embodiments might further contain accessory elements, such as clamps or frictional surfaces to secure, for example, a flag Generally referring to FIGS. 5-7, in one embodiment a user may elevate one or more assemblies along the length of a pole (6) or other surface. In this preferred embodiment, a user may couple one or more installation rods (4) with a rod coupler (15) on a clamp module (23) that may be secured, in this embodiment to another clamp module (23), around a pole (6). In this embodiment, the user may exert an upward force to push, in this case, two modular pole clamp assemblies (20) and/or (19) that are coupled together through at least one additional installation rod (4). The user's applied upward force may allow the coupled pole clamp assemblies (20) to move along the length of the stationary pole (6) to an elevated position.

With the coupled modular pole clamp assemblies (20) and, in this instance, a display flag (5) placed in an elevated position, the elevating installation rod (4) may be coupled with an adjustable joint coupler (17). As generally shown in FIGS. 3-4, in a preferred embodiment, an adjustable joint coupler (17) may be secured to the surface of a pole (6), for example, through a band clamp (11). The adjustable joint coupler (17) may be jointed to allow, for example multi-directional display of the display/flag assembly (1) as well as to assist with the insertion of a supporting installation rod (4) into a rod coupler position (3) on the adjustable joint coupler (17). In a preferred embodiment, a supporting installation rod (4) may be coupled with an adjustable joint coupler (17) through a lock (16), such as a snap-lock, twist lock or button-release lock and the like.

In one embodiment shown in FIG. 9, an adjustable joint coupler (17) may include an external attachment surface (32). In the preferred embodiment, this external attachment surface (32) may include a curved surface that may form a fitted connection with a curved surface, such as those presented by stationary poles. Additional embodiments may include a magnetic attachment, a suction attachment surface and the like. As noted above, in this preferred embodiment, an adjustable joint coupler (17) may be secured to a pole through a band clamp (11) positioned through one band apertures (31)

Figure 5:
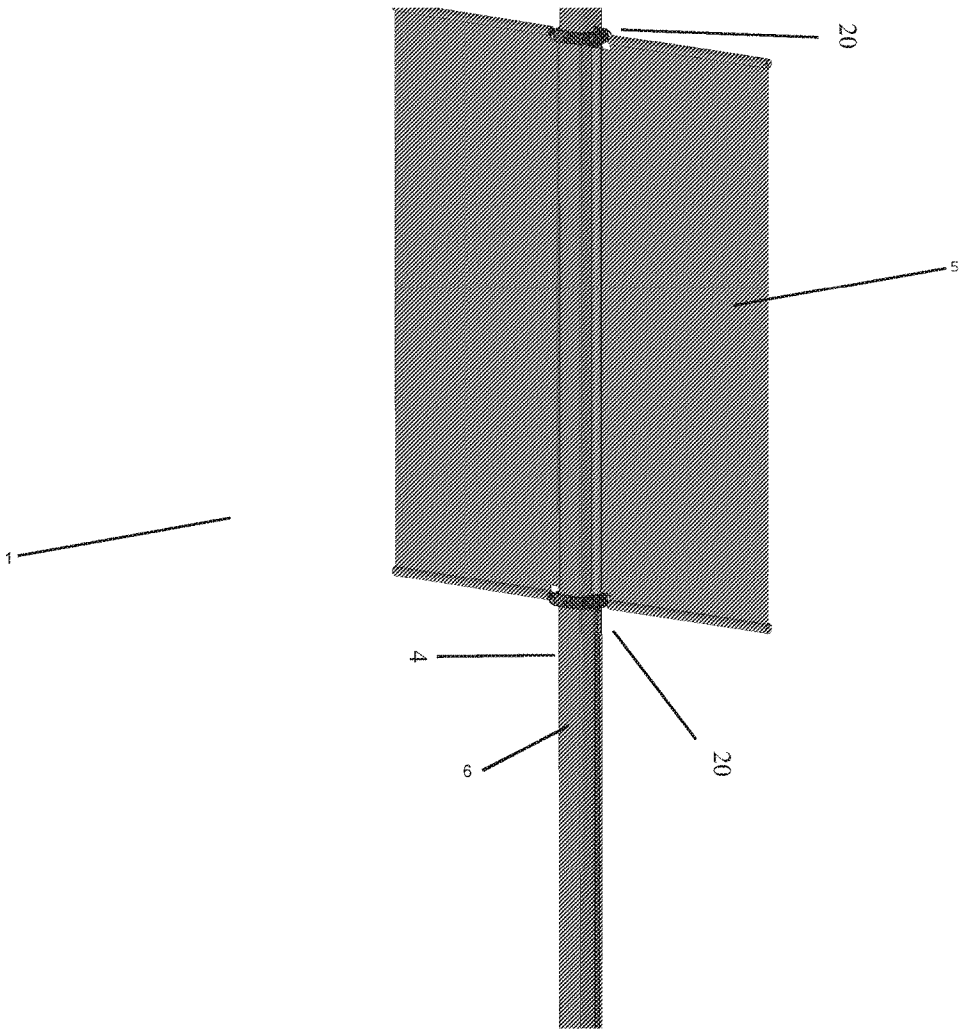
FIG. 5: is a flag assembly having two flags in one embodiment thereof.
Figure 6:
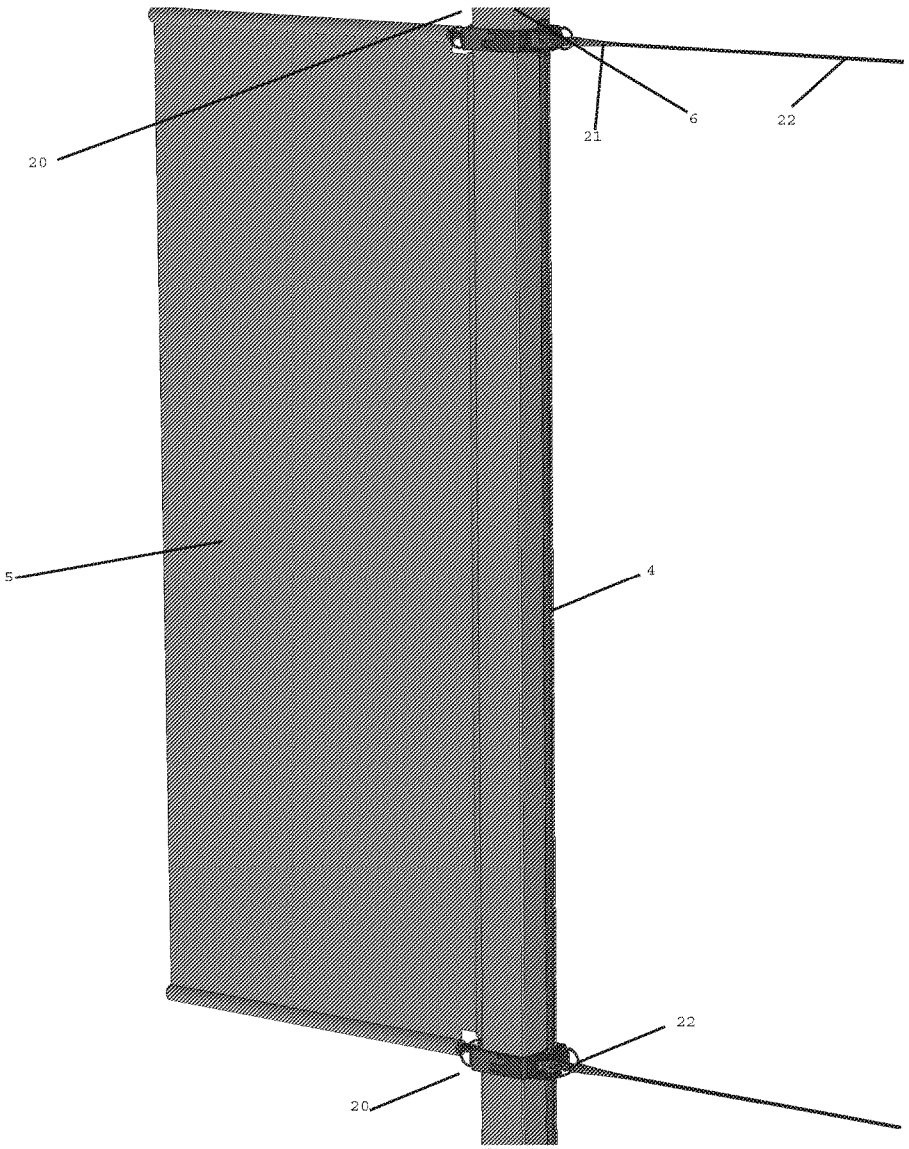
FIG. 6: is a flag assembly having two coupled pole clamp assemblies in one embodiment thereof.

It should be noted that in one embodiment shown in FIG. 5, a plurality of flags (5) may be displayed, in this case in opposing directions, while other embodiments may include a single, or even multiple flags (5) and/or displays at a variety of angles and positions. Additional embodiments may include anti-theft components, such as locks and/or zip-ties that may secure the adjustable joint coupler (17) to the pole, or perhaps the installation rod (4) with the adjustable joint coupler (17) or even pole or other external surface.

Figure 20:
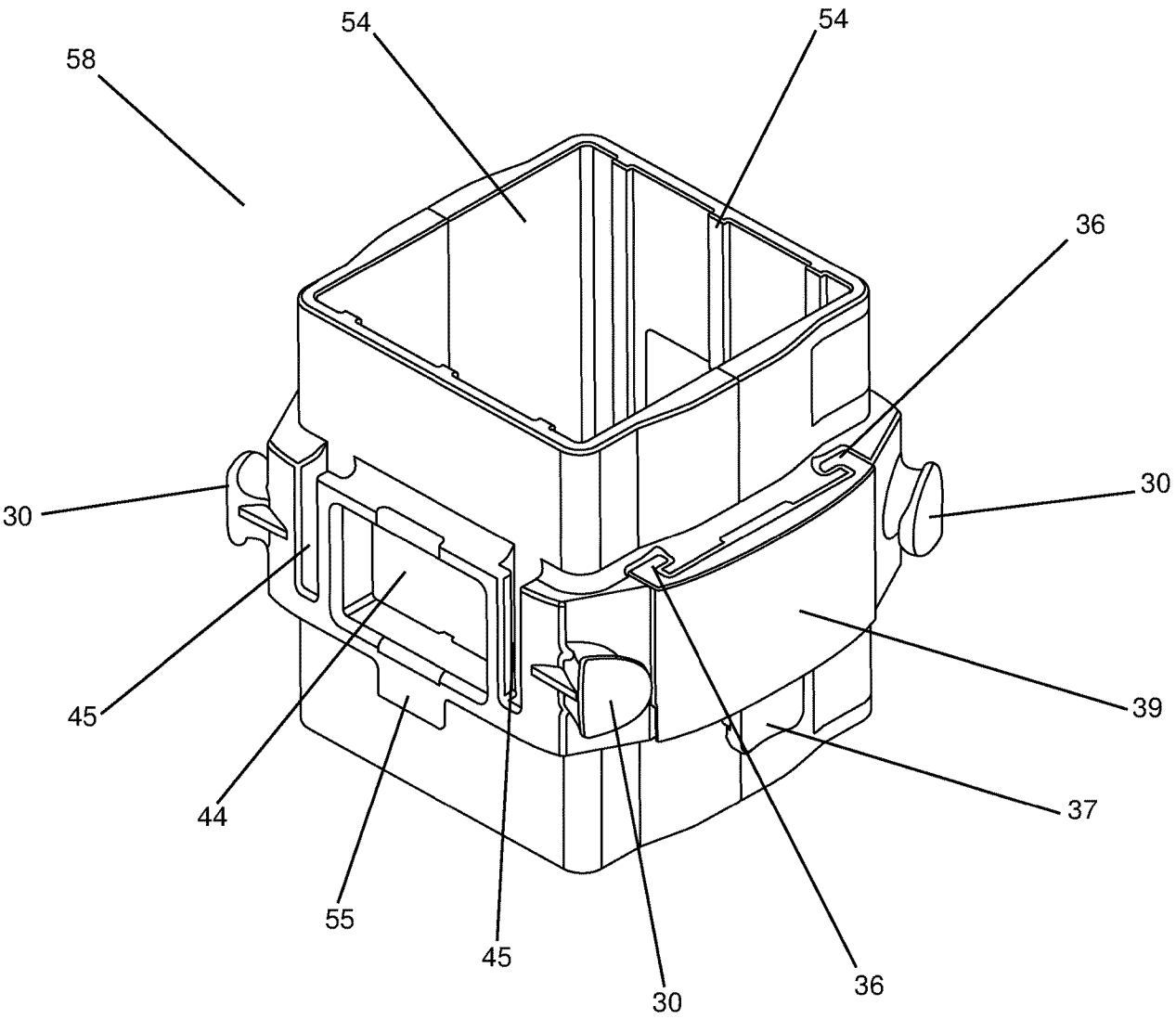
FIG. 20: is a perspective view of two interlocked modular brackets in one embodiment thereof.
Figure 21:
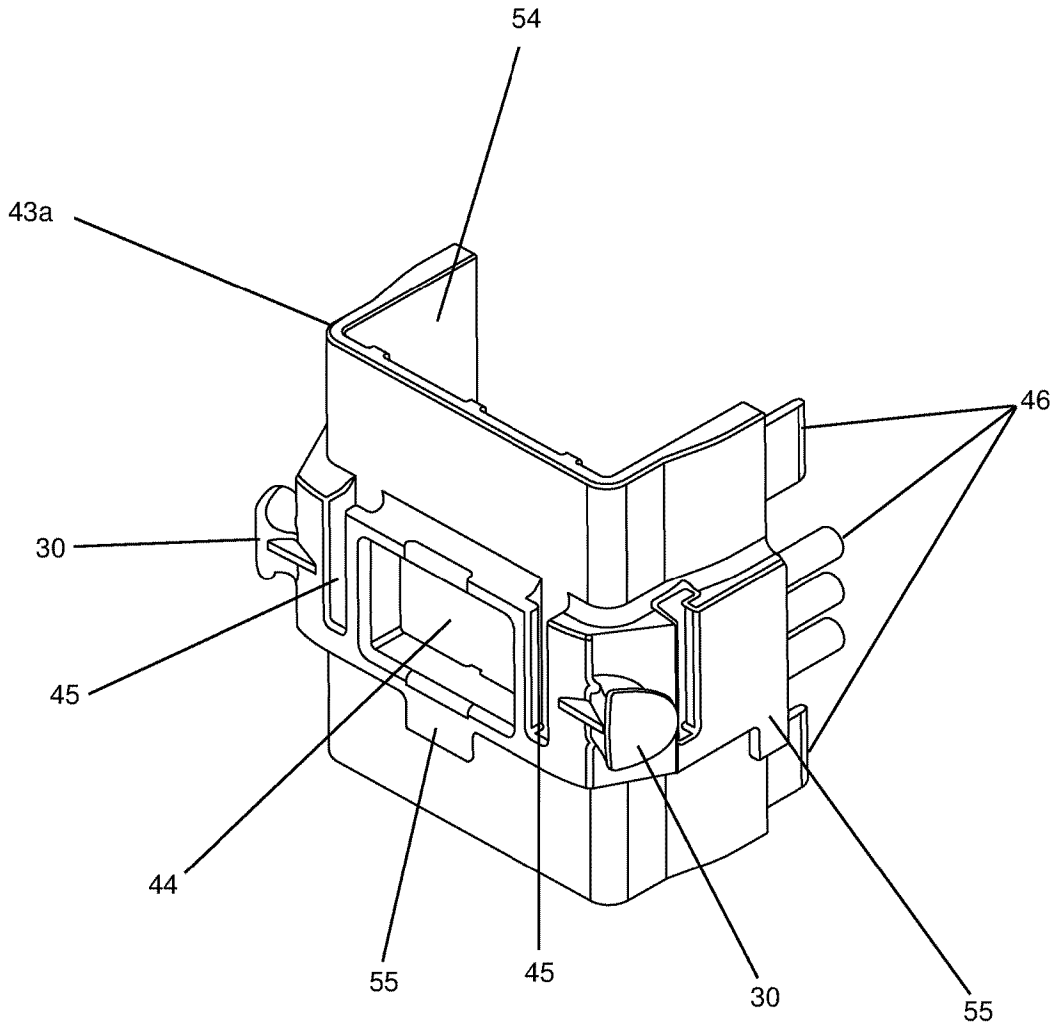
FIG. 21: is a perspective view of a modular bracket in one embodiment thereof.
Figure 22:
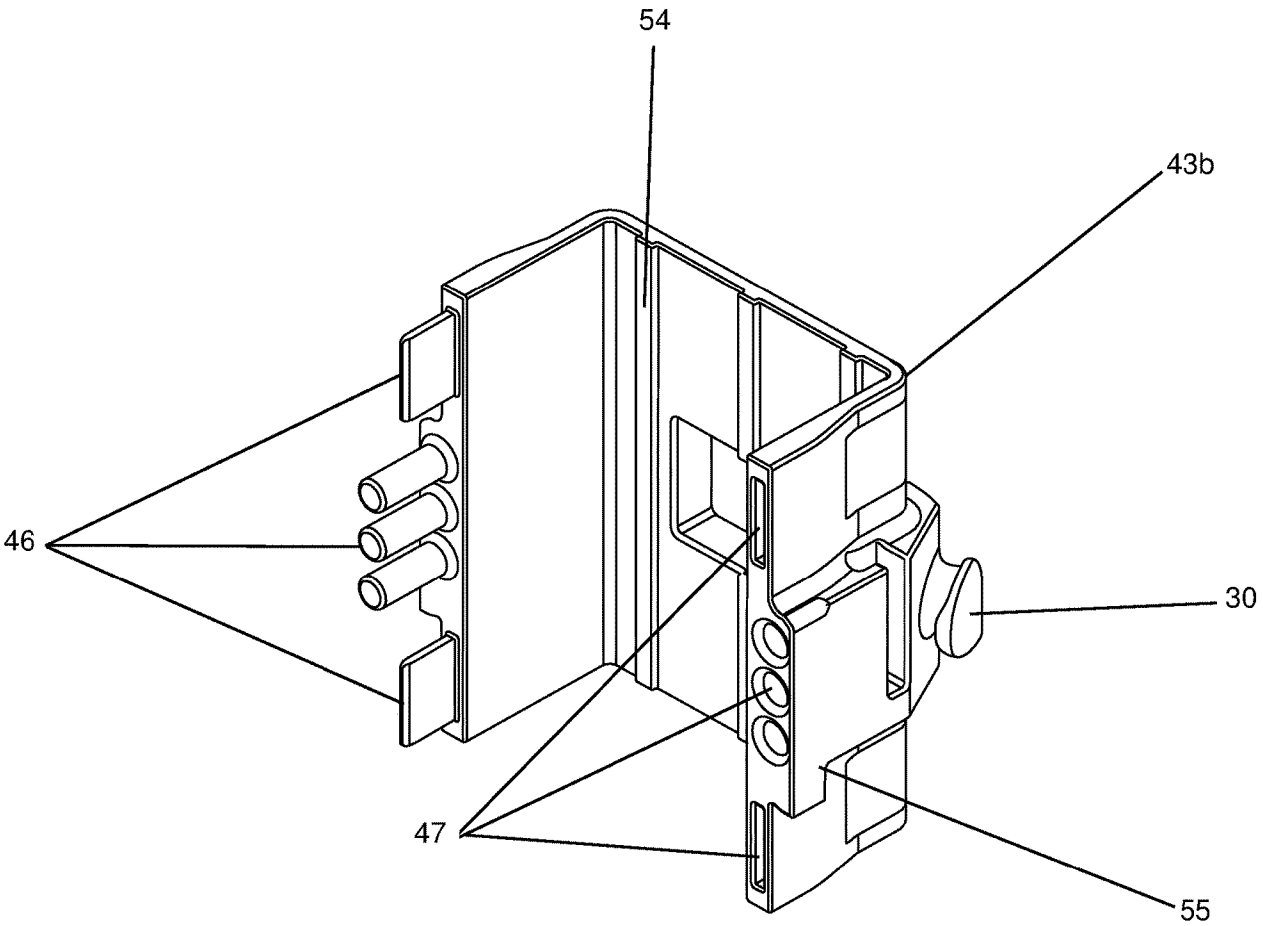
FIG. 22: is a perspective view of a modular bracket having a plurality of bracket guides and bracket slots in one embodiment thereof.

In one embodiment, the inventive technology may include a modular display assembly (34). Generally referring to FIGS. 14-19, in one preferred embodiment the inventive technology may include a modular display assembly (34), which in this embodiment may be coupled to, and/or supported on a pole (6) or other appropriate surface. In one preferred embodiment, a modular display assembly (34)

may include one or more modular brackets (43) that may be configured to be secured to a pole (6), such as a circular or square pole, or other appropriate surface. In one embodiment, such a modular bracket (43) may be formed by interlocking a plurality of individual modular bracket components. Referring to FIGS. 20-22, in this preferred embodiment, a first modular bracket (43*a*) and second modular bracket (43*b*) component may be interlocked with one another around a pole. In an alternative embodiment, a modular bracket (43) may be hinged, such that it may be opened to be placed around a pole (6) or other structure or surface, and perhaps secured with a lock or other fitting. In yet another embodiment, a plurality of modular brackets may be secured around a pole (6) or other structure with a lock, such as a snap lock, catch lock, twist lock, slide lock, quick-release lock or a button lock and the like. Such a lock may be integral with a first and second modular bracket (43*a*) component, or it may be a physically separate locking element, such as a modular insert, as will be discussed below.

Again, referring to FIGS. 20-22, in one embodiment a first modular bracket (43*a*) and/or a second modular bracket (43*b*) component may include one or more bracket guides (46). Such bracket guides (46) in the demonstrated embodiment may include a plurality of shaped projections that may be mated with a corresponding bracket slot (47). This configuration may increase the stability/strength of the coupling of the modular bracket components, but also ensure their proper orientation, for example when placed on a pole (6). In certain embodiments, the bracket slot (47) and bracket guide (46) may form a fitted connection, while an additional embodiment such interlocking may be a locked coupling, such as, for example a snap, twist or slide lock that may secure the position of the modular bracket components. In yet additional embodiments, a modular bracket (43, 43*b*, 43*b*) may include an internal surface configured to help it adhere to an external surface, such as a pole (6). For example, a modular bracket (43, 43*b*, 43*b*) may have an internal frictional surface configured to secure a modular bracket (43, 43*b*, 43*b*) to a pole (6) or other structure or surface. Other embodiments may include a modular bracket (43, 43*b*, 43*b*) that may have an internally positioned magnet or adhesive surface configured to secure a modular bracket (43, 43*b*, 43*b*) to a pole or other structure or surface.

In one embodiment, a modular bracket (43) have one or more modular insert positions (44). Such modular insert positions (44) may be configured to accept a variety of inserts, as will be discussed below, allowing a user to customize the modular display assembly (34) to include multiple displays in multiple configurations and arrangements, as well as in some cases a mix of different displays all at once. In one embodiment, a modular insert position (44) may include one or more bracket adaptors (45). Generally referring to FIG. 33, in one embodiment a first modular bracket (43*a*) and second modular bracket (43*b*) component may be interlocked with one another over a pole (6). Each bracket component may further include a modular insert position (44) that may be coupled with a corresponding insert adaptor (36) on a modular insert which, in some embodiments may include a modular flag insert (35), a blank modular insert (39), a modular balloon insert (40) or a modular insert that supports a variety of displays, signs or advertisements and the like.

In an additional embodiment, modular insert positions (44) may be configured to couple with, and lock into place a variety of inserts, for example with an integral lock, such as a catch or snap lock and the like, or a separate locking mechanism. Generally referring to FIG. 33A-E, in one embodiment a first modular bracket (43*a*) and second modular bracket (43*b*) may be interlocked with one another over a pole (6) and may further include and/or form one or more modular insert positions (44). In this embodiment, each modular bracket component includes a portion of a modular insert position (44) such that when interlocked with another, the modular brackets may form a full modular insert position (44) that may correspond to one or more modular inserts.

In one embodiment, a modular bracket (43) may include a lock or locking mechanism to secure a modular insert. In one preferred embodiment shown generally in FIG. 33, a modular bracket (43), in this case formed by the interlocking of a first modular bracket (43*a*) and second modular bracket (43*b*), may include one or more insert catches (55). In this embodiment, an insert catch (55) may correspond to an insert latch (37) on a modular insert, such as a modular flag insert (35), such that the modular insert may be coupled or locked with the modular insert. Further, in this embodiment, as shown in FIGS. 20 and 33, in one preferred embodiment, a first modular bracket (43*a*) and a second modular bracket (43*b*) may be interlocked with one another over a pole, ad further may have and/or form one or more insert catches (55). In this embodiment, each modular bracket component includes a portion of an insert catch (55) such that when interlocked with one another the modular brackets may form a full insert catch (55) that may correspond to one or more modular inserts. In this preferred embodiment, a modular bracket having a first and second modular bracket (43*a*, 43*b*) components may be configured to interlock with one another around a pole and be secured by at least one modular insert. For example, the coupling of a blank modular insert (39), with a full modular insert position (44) formed by interlocking a first and second modular bracket (43*a*, 43*b*) components may secure and/or lock the interlocked modular bracket (43) into position, in this instance around a pole (6).

Figure 33D:
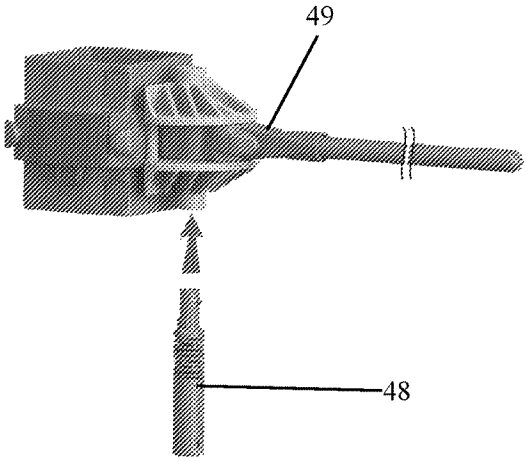
FIG. 33D: demonstrates a part of a stepwise method of assembling a single modular pole flag display assembly in one embodiment thereof.
Figure 33B:
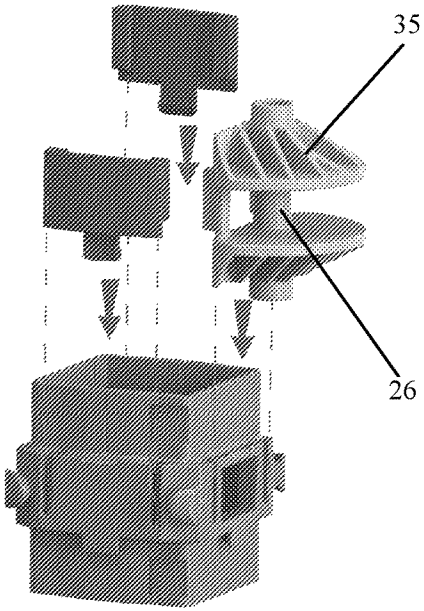
FIG. 33B: demonstrates a part of a stepwise method of assembling a single modular pole flag display assembly in one embodiment thereof.
Figure 33E:
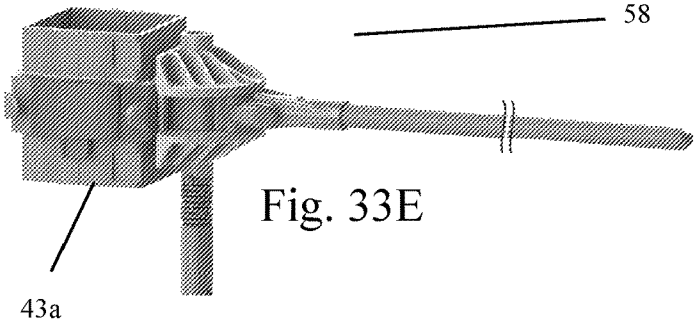
FIG. 33E: demonstrates a part of a stepwise method of assembling a single modular pole flag display assembly in one embodiment thereof.
Figure 33A:
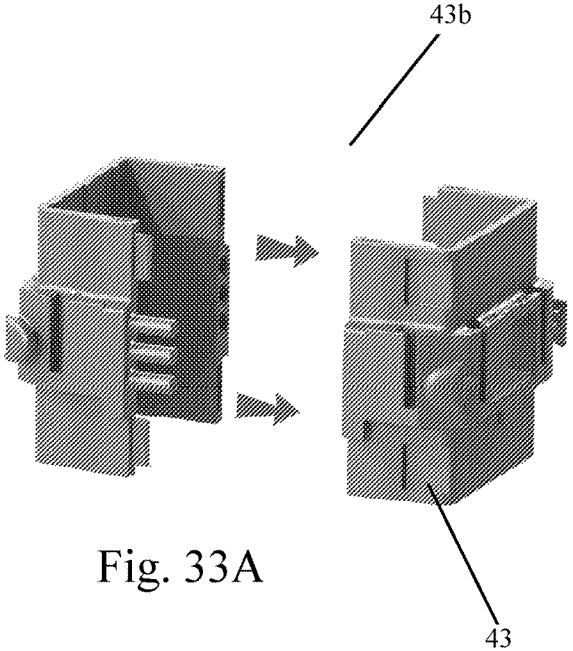
FIG. 33A: demonstrates a method of assembling a single modular pole flag display assembly in one embodiment thereof.
Figure 35B:
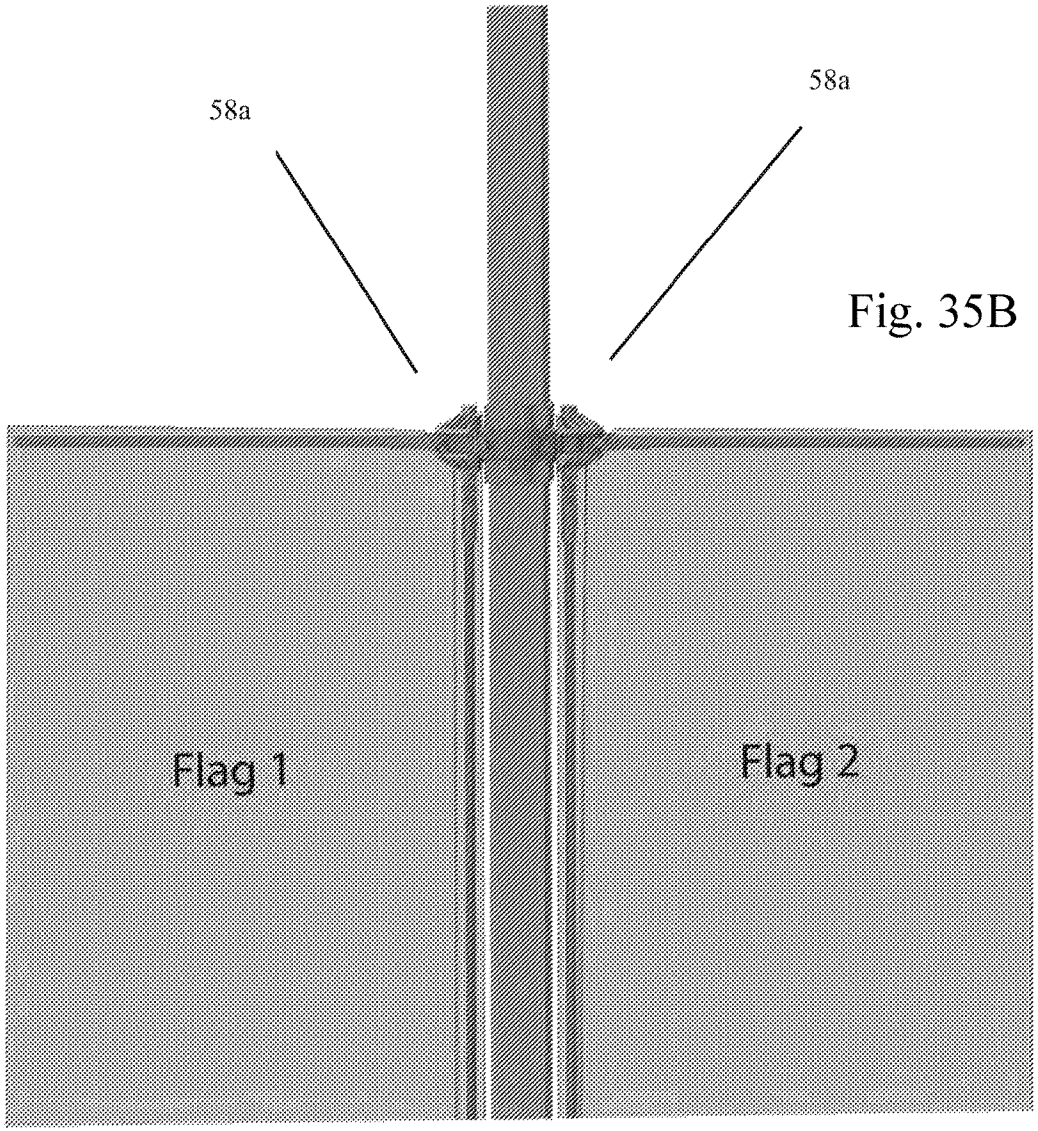
FIG. 35B: is a first and second modular assembly coupled with a plurality of modular flag inserts coupled with a plurality of display flags in one embodiment thereof.
Figure 35A:
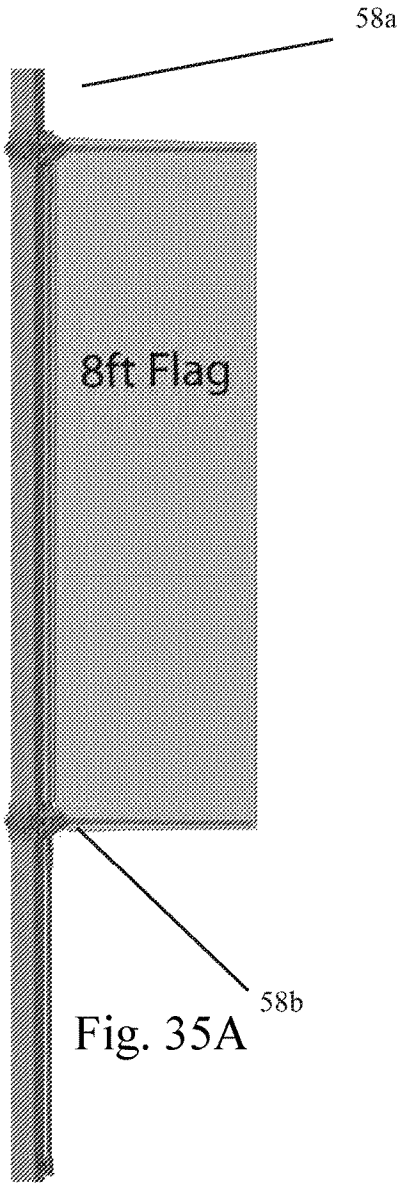
FIG. 35A: is a first and second modular assembly coupled with a plurality of modular flag inserts coupled with a display flags in one embodiment thereof.

In one embodiment, one or more modular inserts may be secured to a modular insert position (44) on a modular bracket (43) forming a first modular assembly (58*a*), for example as shown in FIGS. 35A and B. Specifically, as noted above, a first modular bracket (43*a*) and second modular bracket (43*b*) may be interlocked with one another forming a modular bracket (43). As shown in FIG. 33B, in this preferred embodiment, a plurality of modular inserts may be coupled with the modular bracket (43). In this specific embodiment, a modular flag insert (35) and two blank modular inserts (39) are coupled with modular insert positions (44), in this embodiment by inserting the insert adaptors (36) on each modular insert into the bracket adaptors (45) on the modular bracket (43). The modular inserts may be further secured with the modular bracket (43) by the coupling of the insert latches (37) on the modular inserts (43) with the insert catches (55) on the modular bracket (43) forming a modular assembly (58). Naturally, the number and orientation or even type of modular insert(s) (43) does not limit the formation of a modular assembly (58).

Figure 17:
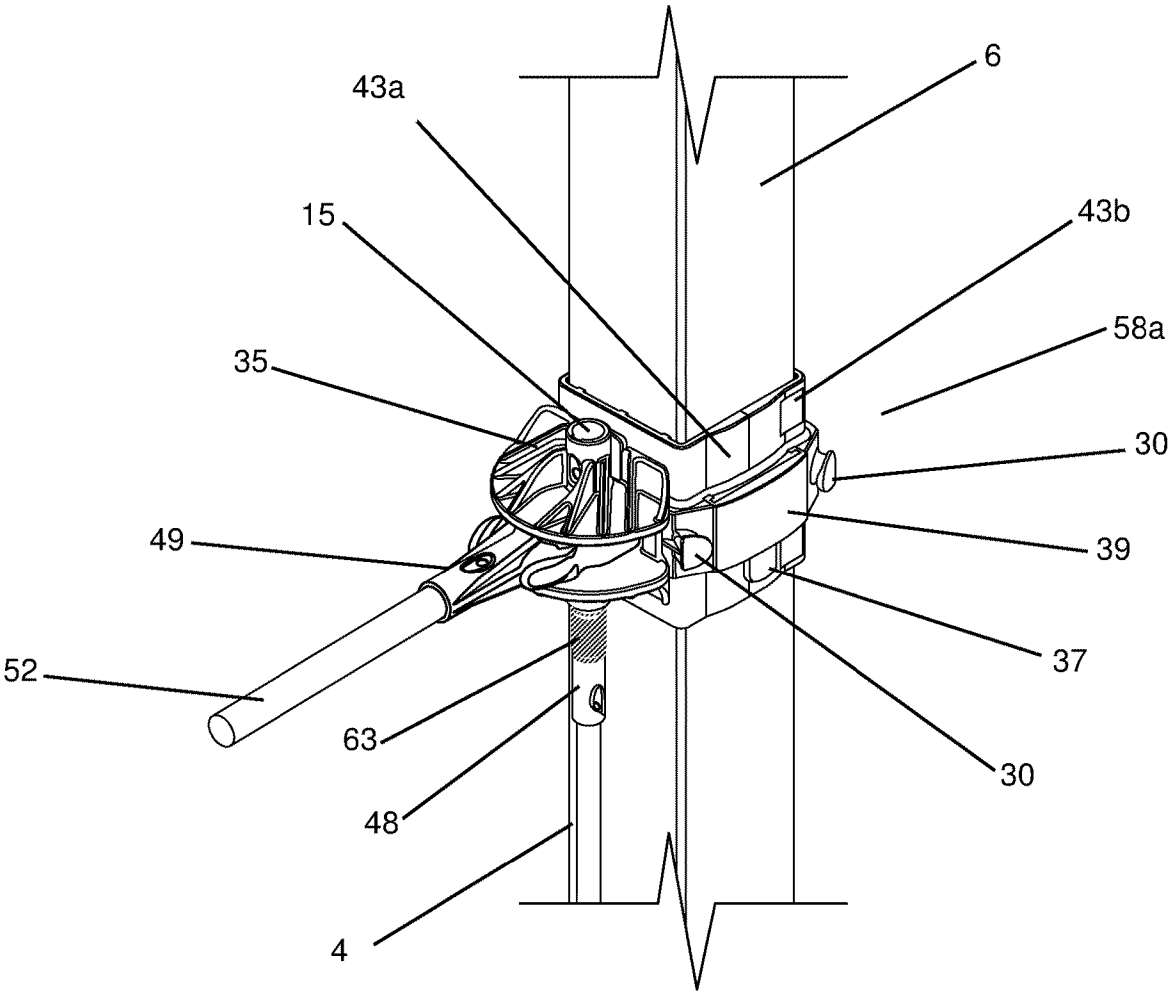
FIG. 17: is a perspective view of a modular pole flag display assembly coupled with a flexible extension connector in one embodiment thereof.
Figure 18:
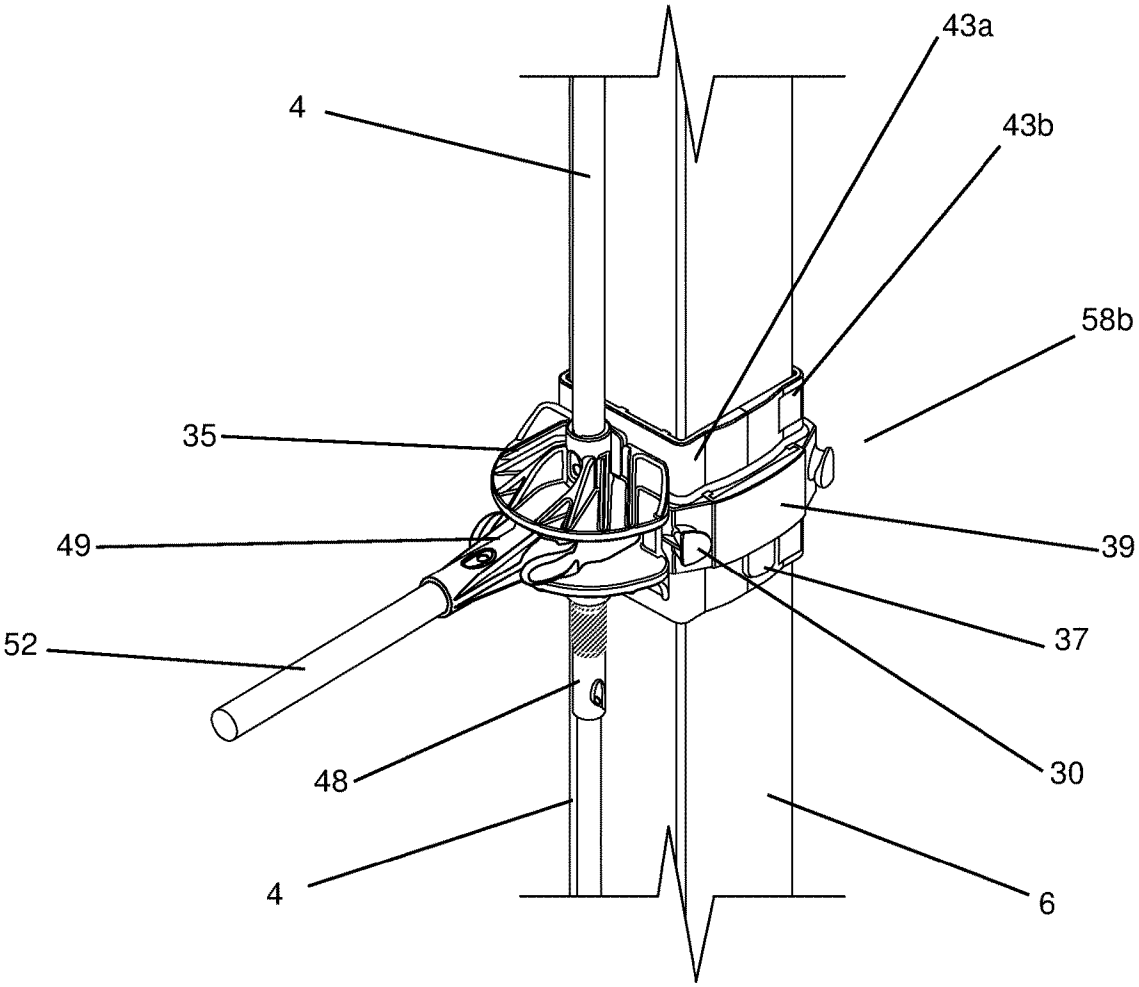
FIG. 18: is a perspective view of a modular pole flag display assembly coupled with flexible extension connector and an installation rod in one embodiment thereof.
Figure 19:
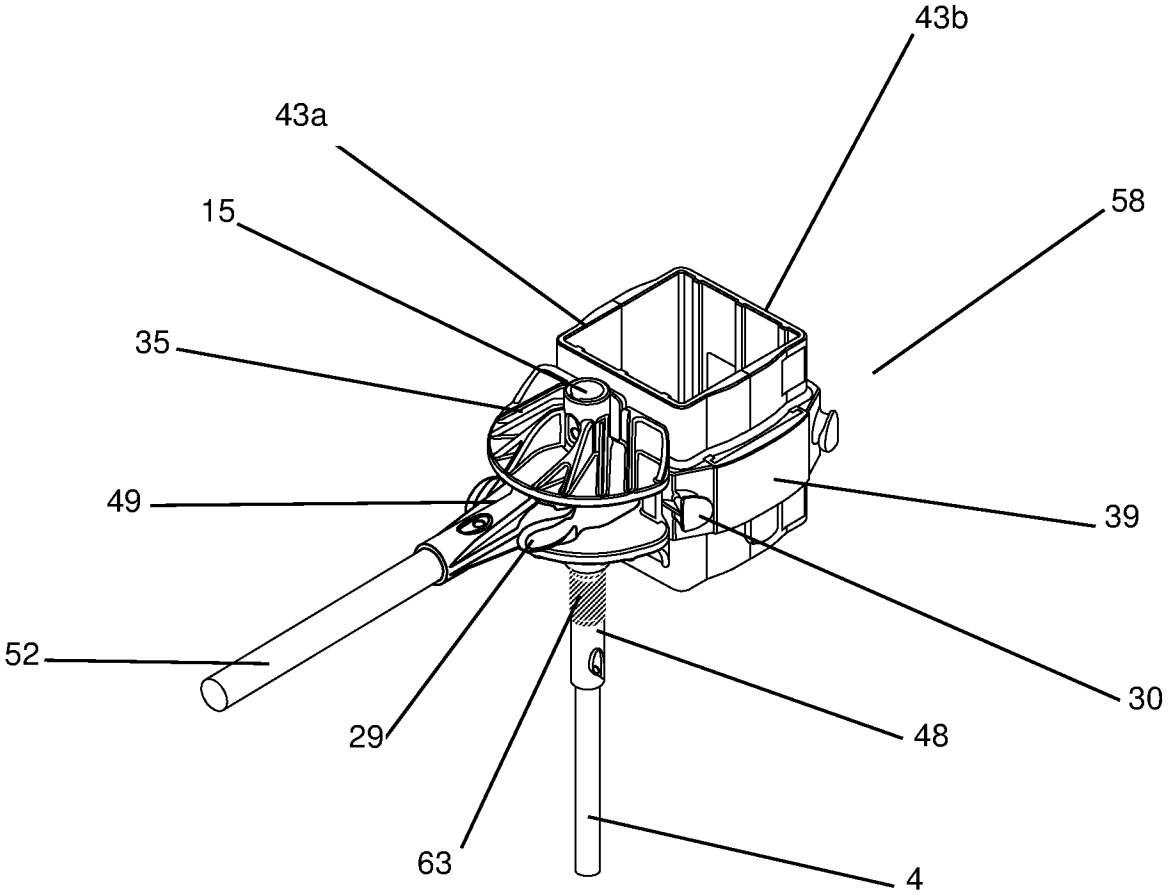
FIG. 19: is a perspective view of a modular pole flag display assembly in one embodiment thereof.

In another embodiment, a modular flag insert (35) may be coupled with a modular bracket (43) forming a modular assembly (58). As shown in FIGS. 17, 18 and 19, in a preferred embodiment a modular bracket (43) may include a modular flag insert (35). In this embodiment, a modular flag insert (35) may include a rod coupler (15) that may be coupled with an installation rod (4), or in some embodiments a flexible extension connector (48). Again, as shown in FIGS. 17-18, an installation rod (4) or flexible extension connector (48) may be inserted into a rod coupler (15) and secured with a coupler lock (38) and support the modular insert (43) and by extension the associated modular assembly (58). In a preferred embodiment, this coupler lock (38) may be a snap lock, a button lock, a slide lock, a twist lock, a fitted lock, or a catch lock and the like.

Figure 15:
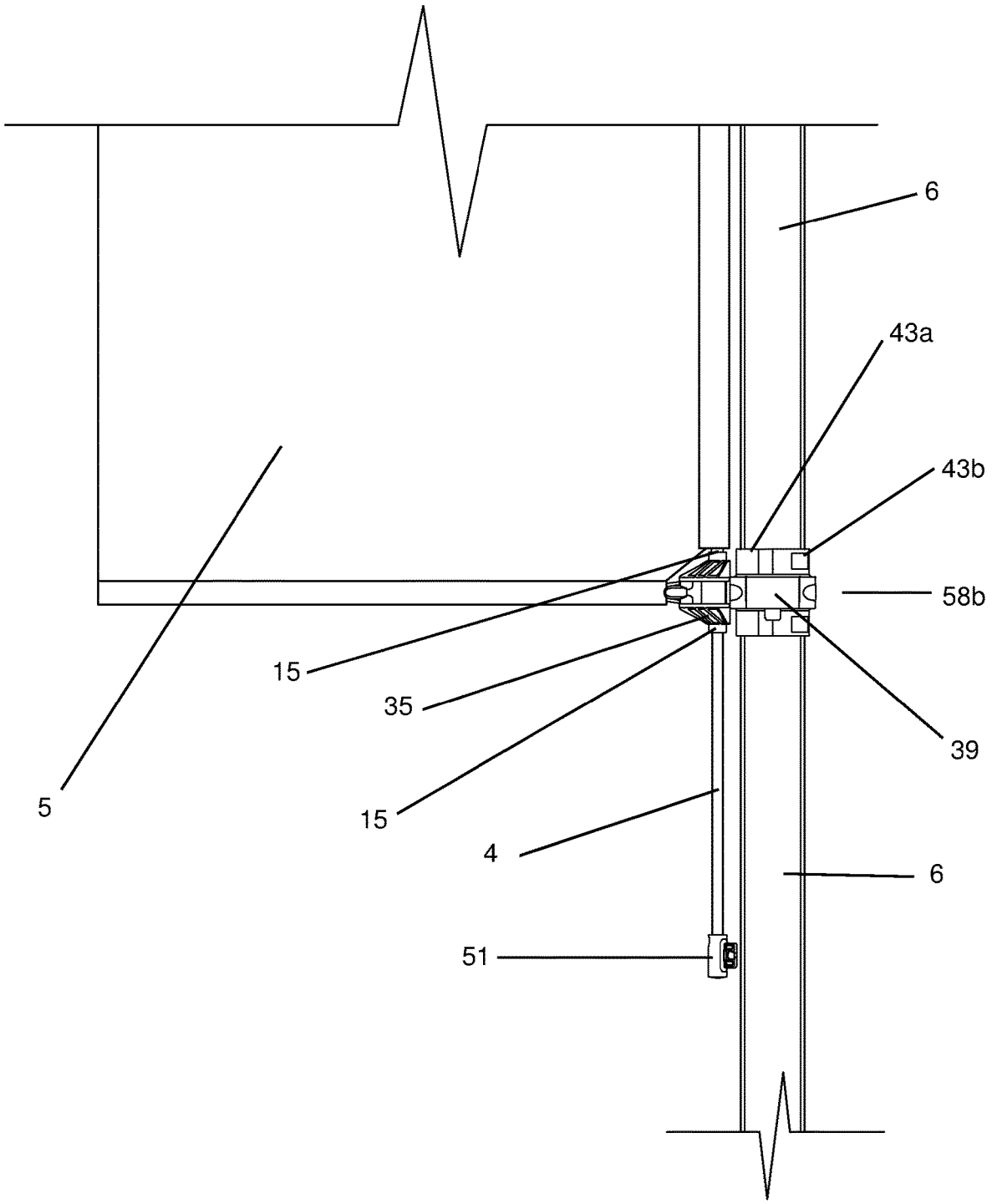
FIG. 15: is a side view of a modular pole display assembly coupled with a flag in one embodiment thereof.

As further shown in FIG. 15, in this preferred embodiment, an installation rod (4) may be coupled with the modular flag insert (35) supporting the modular assembly (58), and may further be coupled with a rod base support (51) that may be secured to the pole (6). In this embodiment, the position of the modular assembly (58) may be determined by the length of the installation pole (4), as well as the position where rod base support (51) is secured to the pole (6). In this configuration it may be possible to secure a modular assembly (58) to the bottom of a pole (6), or the approximate high of a typical user, and then couple the installation rod (4) with the corresponding modular assembly (58), for example through a rod coupler (15) on a modular flag insert (35), and then elevate the assembly to a desired height on the pole (6) and then secure the installation rod (4) with the rod base support (51) which may then be secured to the pole (6). In some instances, multiple installation poles (4) may be joined through the use of one or more internal coupler poles (21). In this embodiment, an internal coupler pole (21) may be inserted into an installation rod (4) and secured with a rod coupler, such as a snap or button lock. In some instances, an additional installation pole (4) may be secured over the other end of the internal coupler pole (21) and secured in a similar manner.

Figure 29:
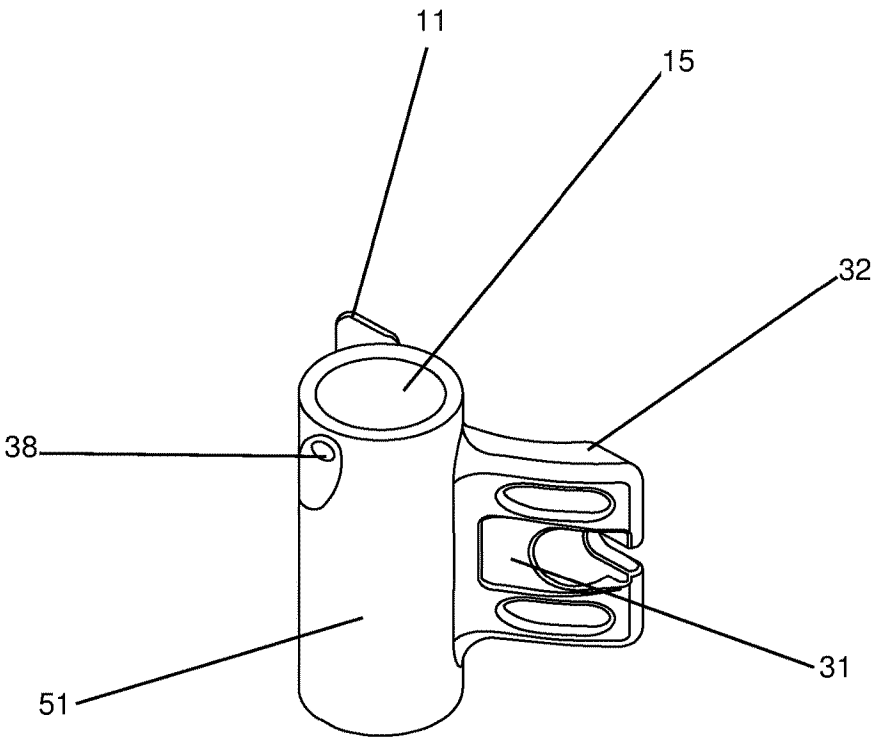
FIG. 29: is a rod base support in one embodiment thereof.

In some embodiments, a rod base support (51) may include an external attachment surface (32) that may be configured to be secured with a pole (6) or other structure. This external attachment surface (32) may be shaped to more closely conform to a desired surface. This external attachment surface (32) may also include a magnetic external attachment surface, an adhesive external attachment surface or other frictional surface that may assist the rod base support (51) in conforming to, in this case the external surface of a pole (6). As demonstrated in FIG. 29, a rod base support (51) may include one or more band apertures (31). In one embodiment, one or more band clamps (11) may be positioned through said band aperture (31) and secure a rod base support (51) to a pole (6) or other structure.

In one embodiment, the inventive technology may include a display that may be coupled with a modular insert. In certain embodiments, a display may include such items as a flag, a balloon or cluster of balloons, a balloon support, or other marketing/advertising signs and the like. In one embodiment one, or even a plurality of displays may be coupled to a modular insert, or in alternative embodiments, a modular bracket (43). Such displays may be coupled directly, or indirectly with a modular assembly (58).

Figure 23:
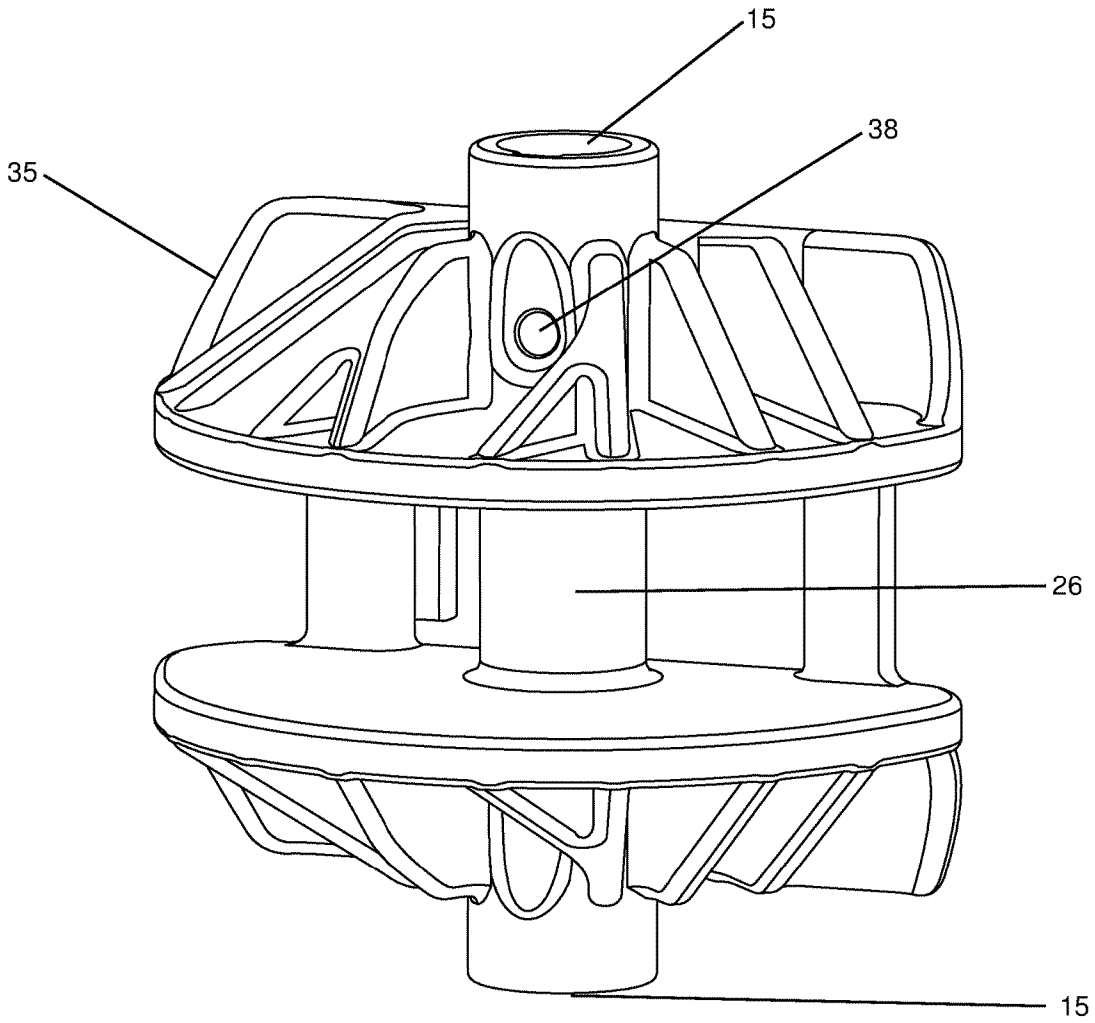
FIG. 23: is a modular flag insert in one embodiment thereof.
Figure 24:
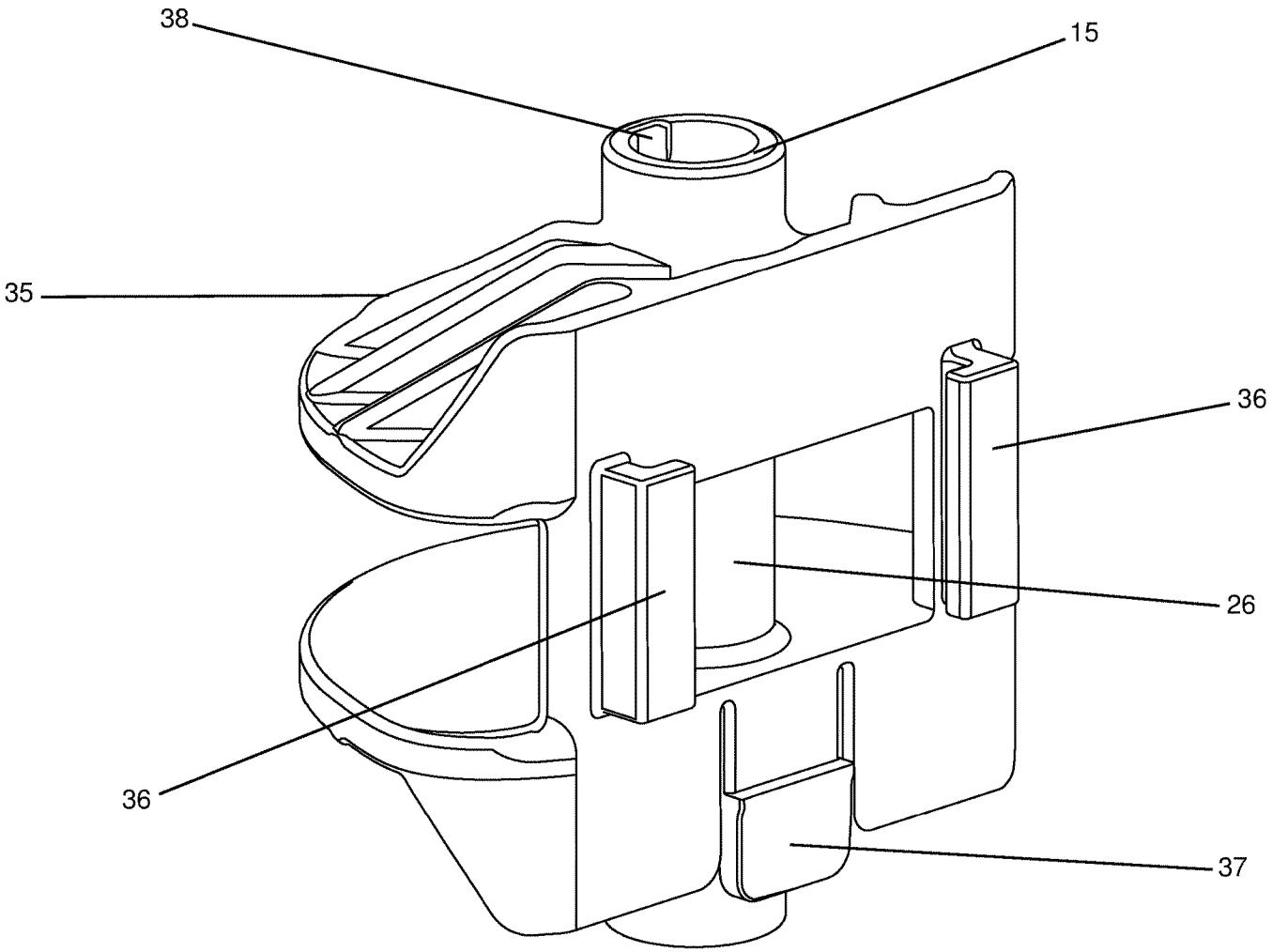
FIG. 24: is a modular flag insert having a plurality of insert adaptors in one embodiment thereof.

For example, in one embodiment shown in FIGS. 17 and 18, a modular flag insert (35) may be coupled with a modular bracket (43) forming a modular assembly (58). As shown in FIGS. 23-24, in one embodiment a modular flag insert (35) may include a stem support coupler (26) that may be configured to be coupled with, or assist in the coupling of a stem (52) that may support a display. In a preferred embodiment shown in FIG. 33B-C, a stem support coupler (26) may include a circular element that may be configured to be coupled with a stem connector (49). In this embodiment, a circular fitted coupler position (28) of a stem connector (49) may be mated with the stem support coupler (26), forming a flexible coupling. In certain embodiments, a flag or display flag (5) (the terms being generally interchangeable) may be secured to stem connector (49), while in other embodiments a stem connector configured to be coupled with at least one stem (52) as shown in FIG. 33C. In this embodiment, for example a flag, or display flag (5) may be secured by the stem (52), or in some cases the stem (52) and an installation pole (4). In this embodiment, a stem (52) may be inserted into a sleeve or top edge flag guide (59) along the top leading edge of a flag (5) while an installation pole (4) may be inserted into a sleeve or side edge flag guide (60) along a side edge of a flag (5). Additional embodiments may include additional attachment components, such as bands, Velcro®, straps, ties and the like.

As noted above, in some embodiments, a stem connector (49) may be mated with the stem support coupler (26) forming a flexible coupling. In this embodiment, this flexible coupling may allow lateral movement of the stem connector (49) in relation to a statically positioned modular flag insert (35). In this embodiment, a flag (5), in response to wind may be allowed to move laterally allowing, on the one hand a more realistic appearance of flag movement, while also allowing substantial lateral movement of the flag (5) in response to a high wind which may cause the flag to approximately align with the direction of the wind and prevent stress on any components which could break or become distorted under high wind conditions. In additional embodiments, a stem (52) may be flexible, further allowing lateral, as well as additional multi-directional movement which may further protect the components and allow an attached flag to orient itself to prevent stress on any components which could break or become distorted under high wind conditions. It should also be noted that a stem coupler (49) and a stem (52) may be a unitary or integral component in certain embodiments. Additional embodiments may include a jointed stem connector. In this embodiment, a stem (52) may be integral to, or coupled with a stem connector (49) having a joint that may, in response to a high wind, trigger the joint to bend allowing, in this instance a display flag (5) or other display to be positioned to decrease the stress on the stem (52) or stem connector (49) preventing damage to the display. Such joint, may be tensioned, for example with a spring or other components to allow it to return to an original position in the absence of the wind force.

Figure 30:
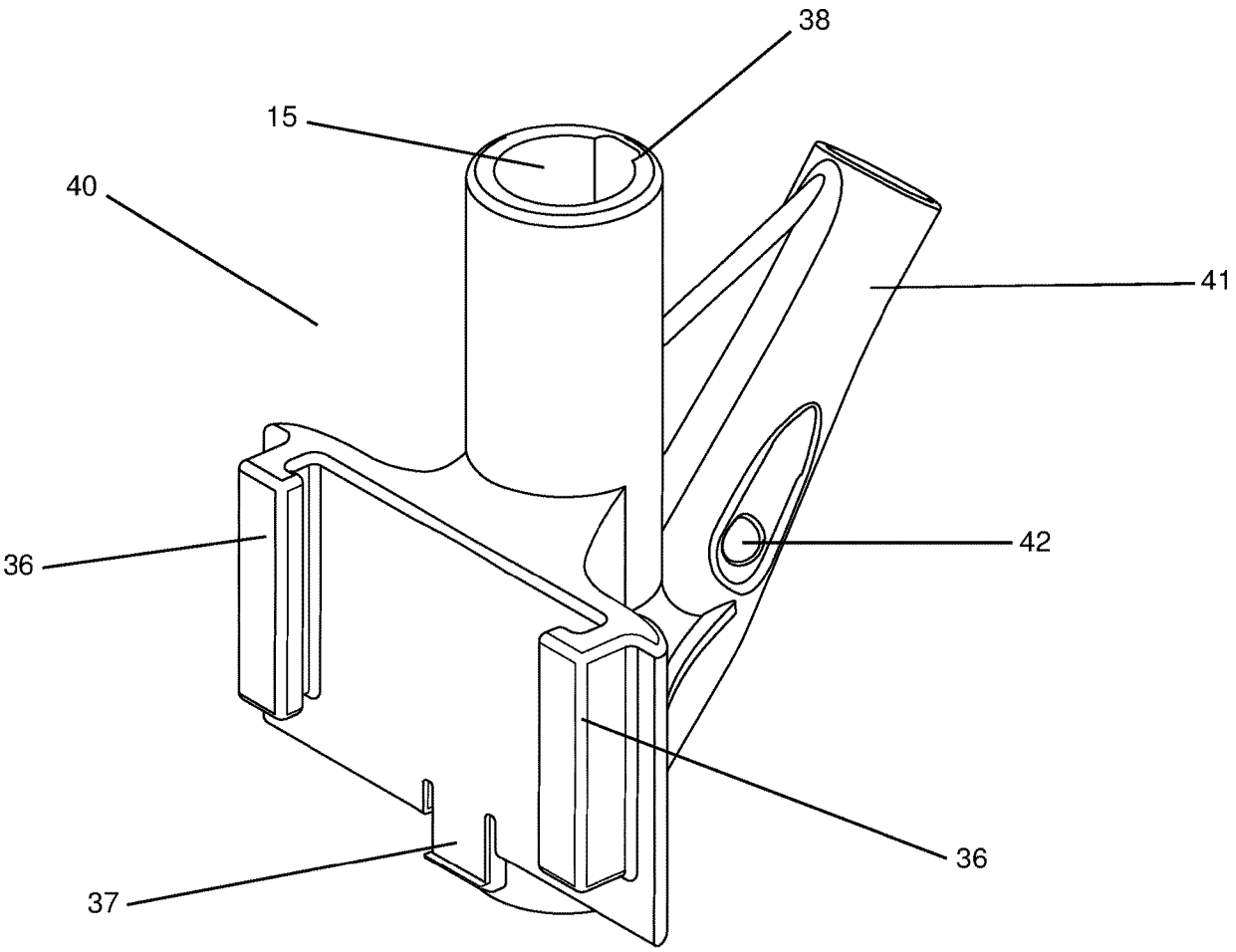
FIG. 30: is a back-perspective view of a modular balloon insert having a plurality of insert adaptors in one embodiment thereof.
Figure 31:
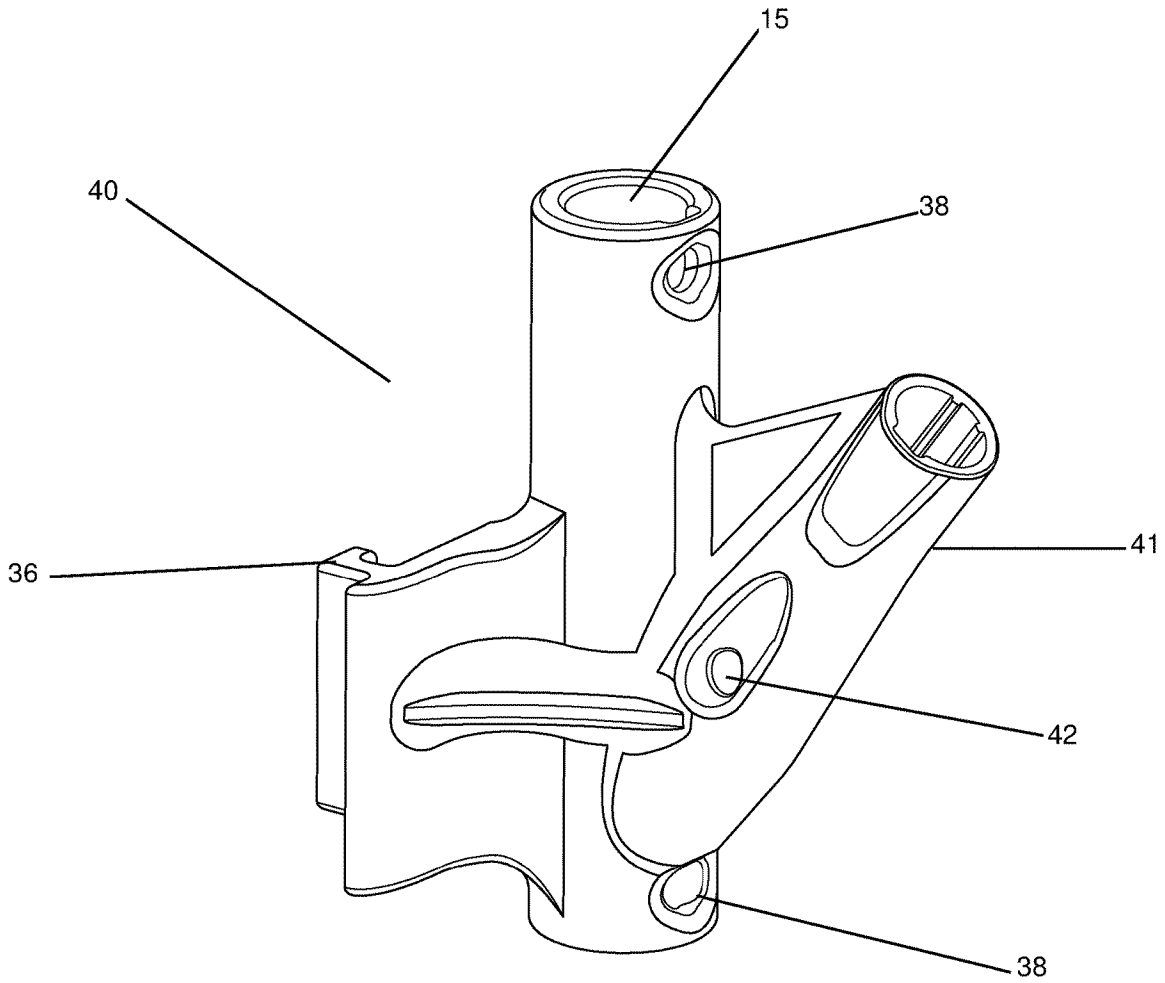
FIG. 31: is a front perspective view of a modular balloon insert having a balloon stem support in one embodiment thereof.
Figures 32A, 32B, 32C:
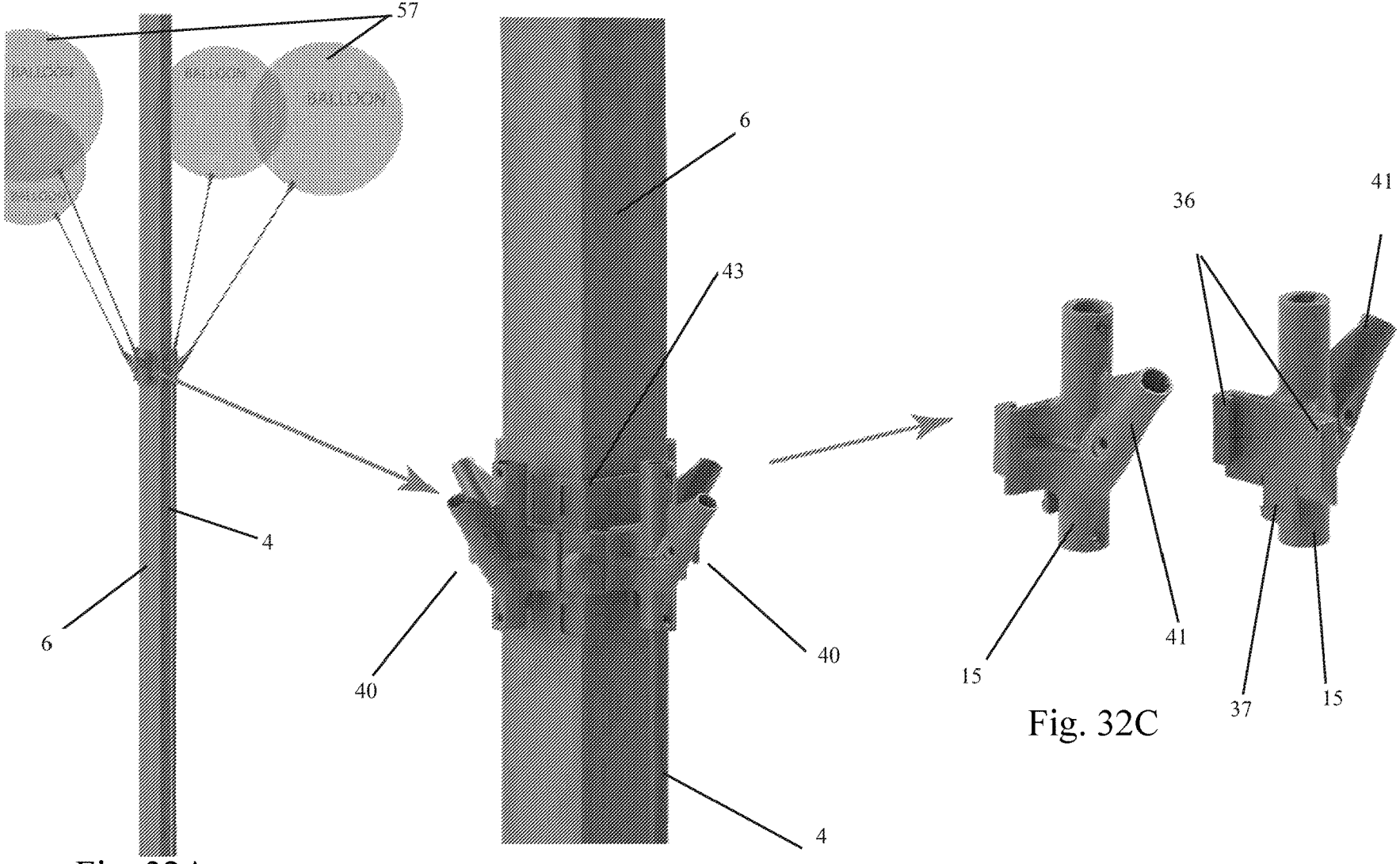
FIG. 32A: is a modular pole balloon display assembly in one embodiment thereof.
FIG. 32B: is a modular pole balloon display assembly in one embodiment thereof.
FIG. 32C: is a balloon stem support in one embodiment thereof.
Figure 32C:
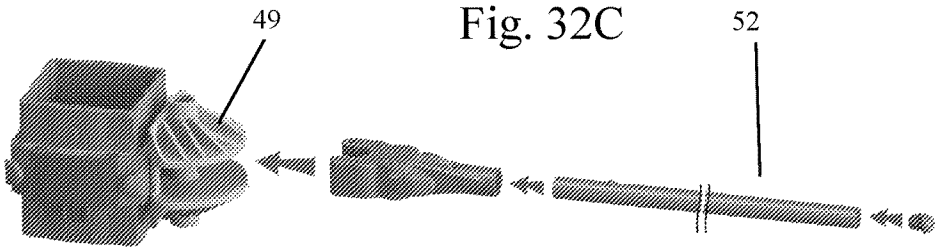

In one embodiment, the invention may include a modular pole balloon display assembly (56). Generally referring to FIG. 32A-C, in one preferred embodiment a modular pole balloon display assembly (56) may include at least one modular bracket (43) that may be configured to be secured to a pole (6) and may further have one or more modular insert positions (44). As shown in FIGS. 30-31 and 32C, in this preferred embodiment at least one modular balloon insert (40) may be configured to be secured to a modular bracket (43) at a modular insert position (44) forming a modular assembly (58). In this preferred embodiment, one, or as shown in FIG. 32, a plurality of modular balloon inserts (40) may be coupled with a modular bracket (43) at modular insert positions (44). In this embodiment, this coupling may be accomplished by inserting the insert adaptors (36) on each modular balloon insert (40) into the bracket adaptors (45) on the modular bracket (43). One or more modular balloon inserts (40) may be further secured with the modular bracket (43) by the coupling of the insert latches (37) on the modular balloon inserts (40) with insert catches (55) on the modular bracket (43) forming a modular assembly (58). Naturally, the number and orientation of modular balloon inserts (40) does not limit the formation of a modular assembly (58).

Referring again to FIGS. 30-31 and 32C, in one embodiment, one or more rod couplers (15) may be coupled with, or integral to a modular balloon insert (40). In this embodiment, the modular balloon insert (40) may form a single cast or molded component, for example a single component formed through injection molding, or 3-D printing techniques and the like. Referring to FIG. 32B, in this embodiment an installation rod (4) may be secured by the rod coupler (15), for example through a fitted connection or a lock, such as a snap lock, a button lock, a slide lock, a twist lock and the like. This installation rod may further be coupled with a rod base support (51) that may be secured to a pole. In this configuration, the installation pole (4) may support the modular balloon insert (40) and associated components, such as modular bracket (43). It should be noted that in alternative embodiments a rod coupler (15) may be present on a modular bracket (43) or other component.

Referring now to FIG. 32A, this modular pole balloon display assembly (56) embodiment may include one or more balloon stems (53) that may be secured with one or more modular balloon inserts (40). In a preferred embodiment, a balloon stem (53) may be an elongated, pliable, or semi-pliable rod that may be coupled with, and/or secure one or more balloons, or helium-free balloons (57) or other displays. In additional embodiments, such balloon stems (53) may include a balloon coupler that may, for example include, a manifold that may secure a plurality of helium-free balloon (57).

In this embodiment, a balloon stem (53) may be coupled with a balloon stem support (41) and may further be secured through a balloon stem lock (42). In this embodiment, balloon stem support (41) may be angled such that the stem is positioned pointing away from the pole (53). In this embodiment, an air-filled helium-free balloon (57) may be able to move in response to wind energy, thus providing the appearance of floating.

Consistent with the inventive technology, in certain embodiments a plurality of modular brackets (43) having a plurality of modular insert positions (44) may be secured to a pole (6) in series. In this embodiment, a variety of inserts may be secured to the modular brackets (43) positioned in series forming a series of modular assemblies (43). In one embodiment, a plurality of modular assemblies (43) may be positioned in series around a pole and may be supported by the bottom modular assembly (58) coupled with an installation rod (4), for example through a rod coupler (15) on the bottom modular bracket (43) or the bottom modular insert. As described above, this installation rod (4) may be coupled with a rod base support (51) which may be secured to a pole (6). In this embodiment, for example a plurality of modular balloon inserts (40) may be coupled with each modular bracket (43) in series, each insert being coupled with one or more helium-free balloons (57), for example through a stem (52) coupled with a balloon stem support (41) on the modular balloon insert (40). In this configuration, the balloon stem support (41) on a modular balloon inserts (40) may be configured in series along the length of a pole or other surface or structure in a uniform orientation to form a single line of helium-free balloons (57), or they may be oriented in an off-set or staggered configuration, for example to form a single line of helium-free balloons (57) in a spiral configuration respectively. Naturally, additional modular inserts (43) may be mixed and matched to form a fully customizable display.

Figure 25:
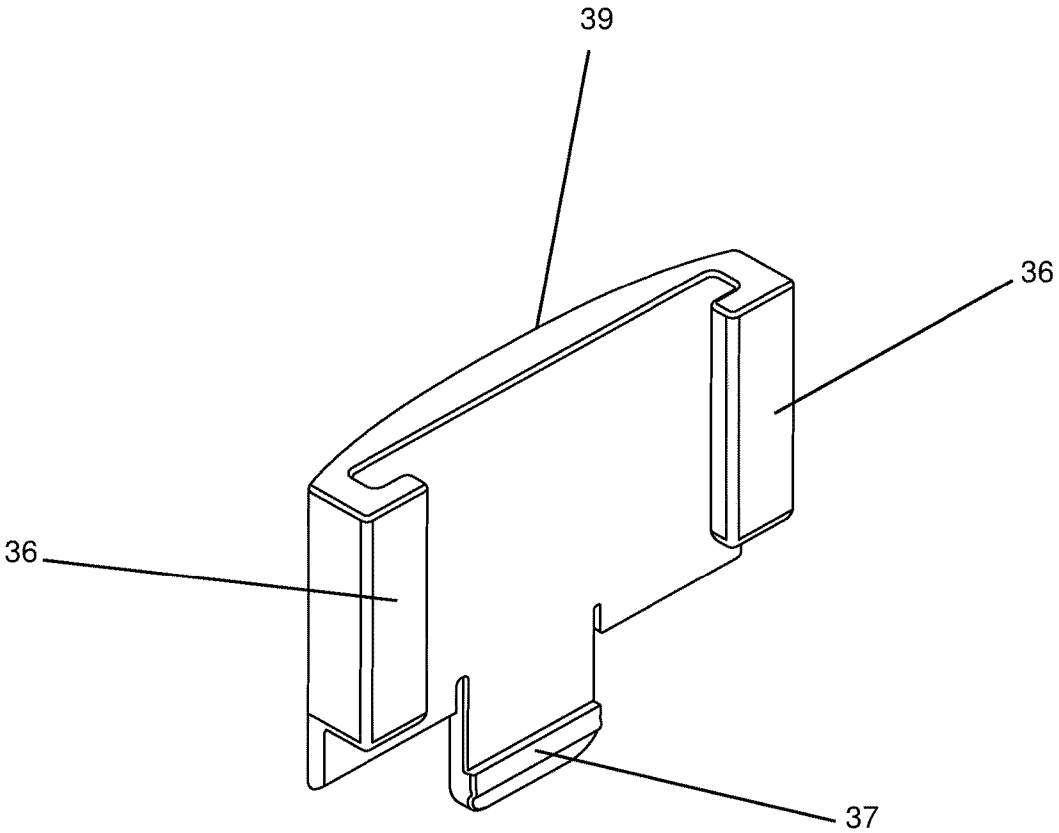
FIG. 25: is a blank modular insert having an insert latch in one embodiment thereof.
Figure 26:
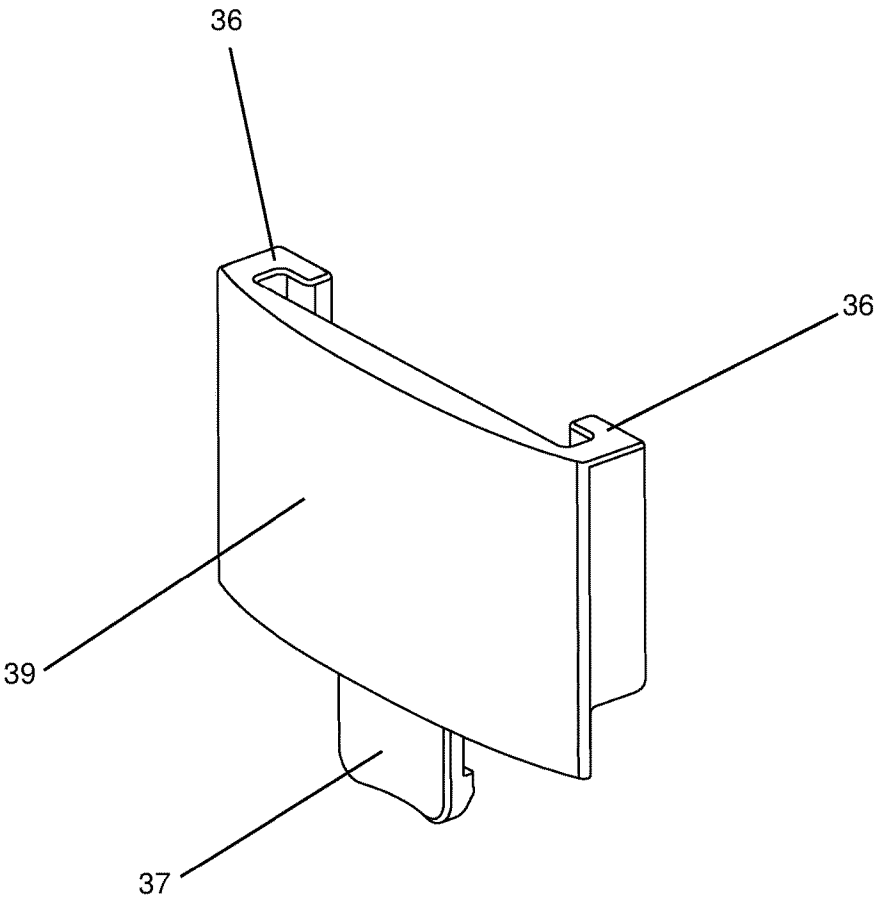
FIG. 26: is a blank modular insert having a plurality of insert adaptors in one embodiment thereof.

In one embodiment, the inventive technology may include a modular display assembly (34) having a first modular bracket (43*a*) configured to be secured to a pole (6) having one or more modular insert positions (44). A first modular insert, such as a blank modular insert (39) as generally shown in FIGS. 25-26, modular balloon insert (40), or a modular flag insert (35) may be secured to a first modular bracket (43*a*) forming a first modular assembly (58*a*). A second modular bracket (43), also having one or more modular insert positions (44) may be secured to a pole (6), in this embodiment below the first modular assembly (58*a*). Similarly, a second modular insert, such as a blank modular insert (39), modular balloon insert (40) or a modular flag insert (35) may be coupled with the second modular bracket (43*b*) forming a second modular assembly (58*b*). At least one installation rod (4), flexible extension connector (48), or flexible extension connector (48) coupled with an installation rod (4) may be used to join or couple the first and second modular assemblies (58*a*, 58*b*). In this embodiment, one or more displays may be coupled with one or both modular inserts.

The invention, in another embodiment may include a modular pole flag display assembly (62). Generally referring to FIGS. 14-20, in one preferred embodiment, a modular pole flag display assembly (62) may include a first modular bracket (43*a*) which may be configured to be secured to a pole (6) and may further have one or more modular insert positions (44). A first modular flag insert (35) may be secured to, or coupled with, the first modular bracket (43) forming a first modular assembly (58*a*). In the preferred embodiments shown in FIGS. 14-20, the first modular flag insert (35) may include one or more rod couplers (15).

Figure 28:
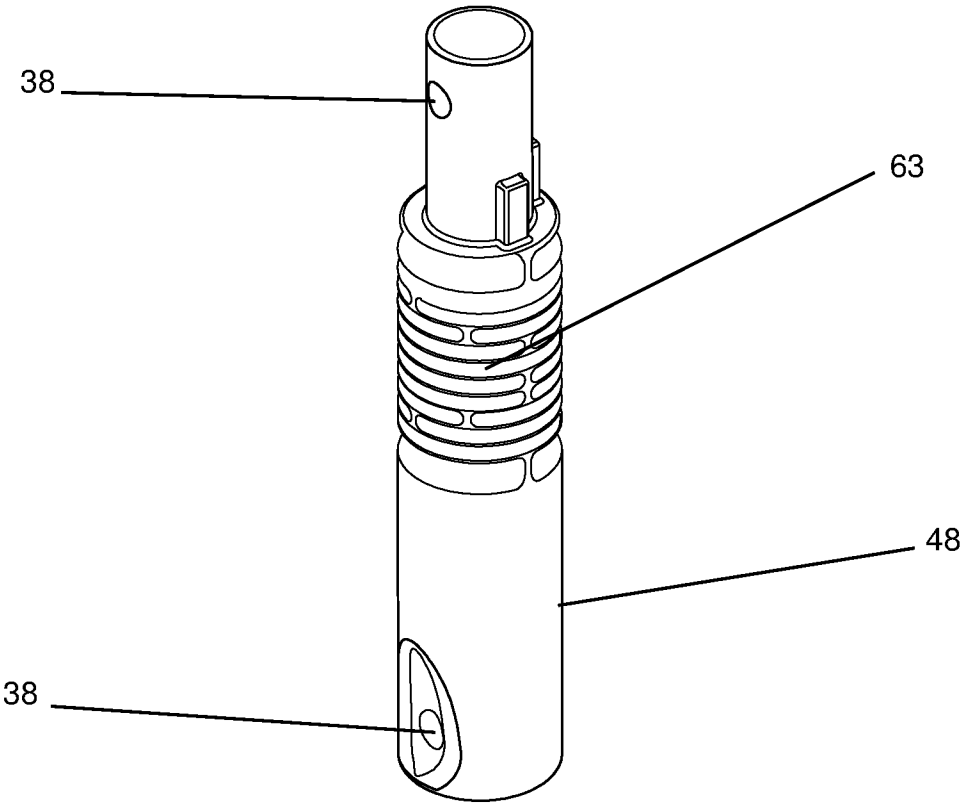
FIG. 28: is a flexible extension connector in one embodiment thereof.

In one embodiment, a rod coupler (15) positioned on the underside of the modular flag insert (35) may be coupled with a flexible extension connector (48). Such coupling may be a fitted coupling, or may be coupled through a lock, such as a snap, twist, button, slide or latch lock and the like. As shown in FIG. 28, in one embodiment a flexible extension connector (48) may include one or more coupler locks (38) configured to accept an installation rod (4), or a rod coupler (15) at either end. Also, in this preferred embodiment the flexible extension connector (48) may include a flexible region (63) which may allow it to bend, in some instances to approximately 90 degrees. In the embodiment shown in FIG. 28, such flexibility may be a result of having interlocking carve-outs at one end of the connector which may allow it to flex. Additional embodiments may include a rotatable or swivel joint that may allow movement of a flexible extension connector (48) in one or a plurality of directions. Referring to FIG. 17, in one embodiment a stem connector (49), in this instance identified as a first stem connector (49) may be coupled, in some cases flexibly or statically, with a modular flag insert (35).

Figure 14:
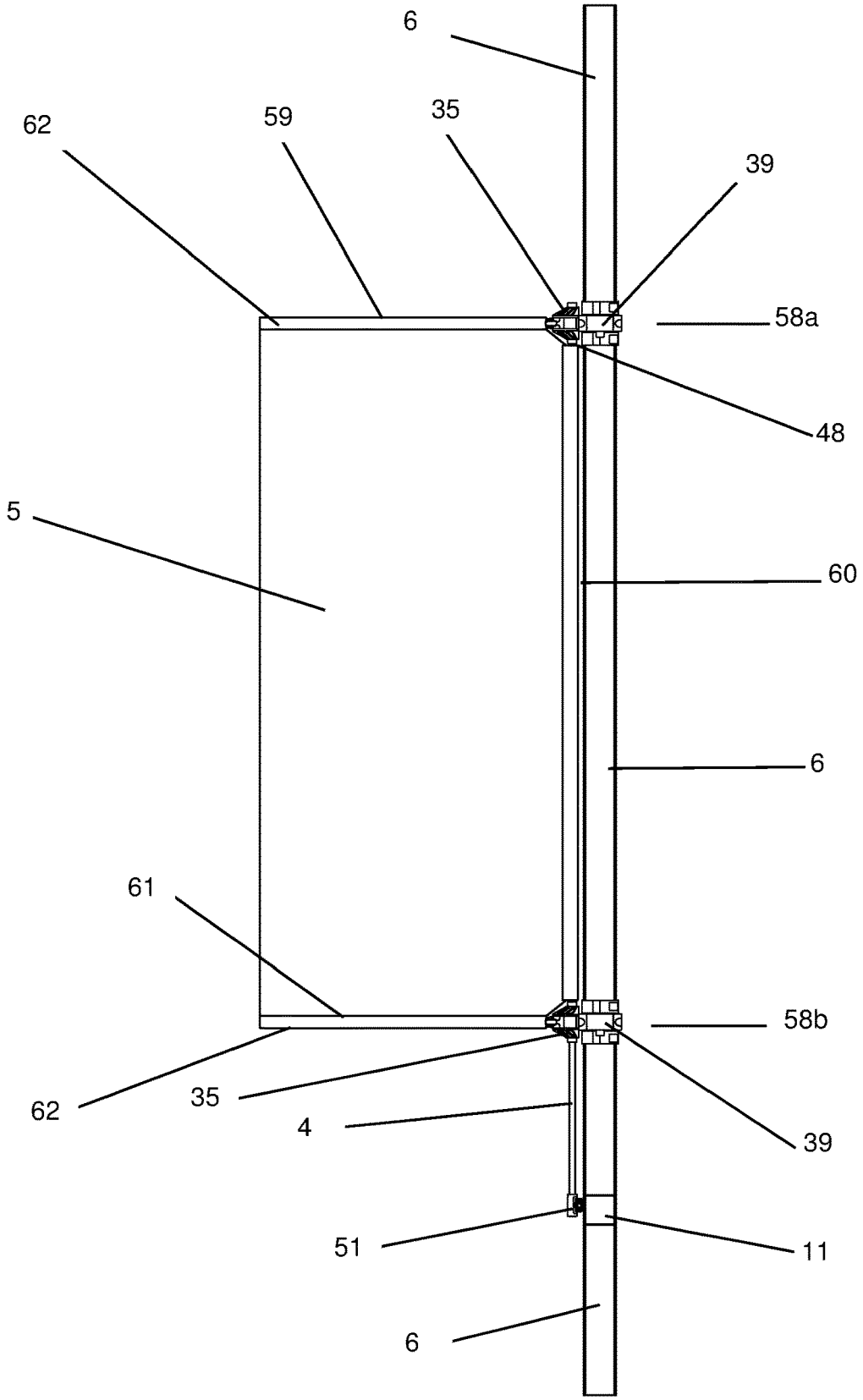
FIG. 14: is a modular pole display assembly coupled with a flag and pole in one embodiment thereof.
Figure 16:
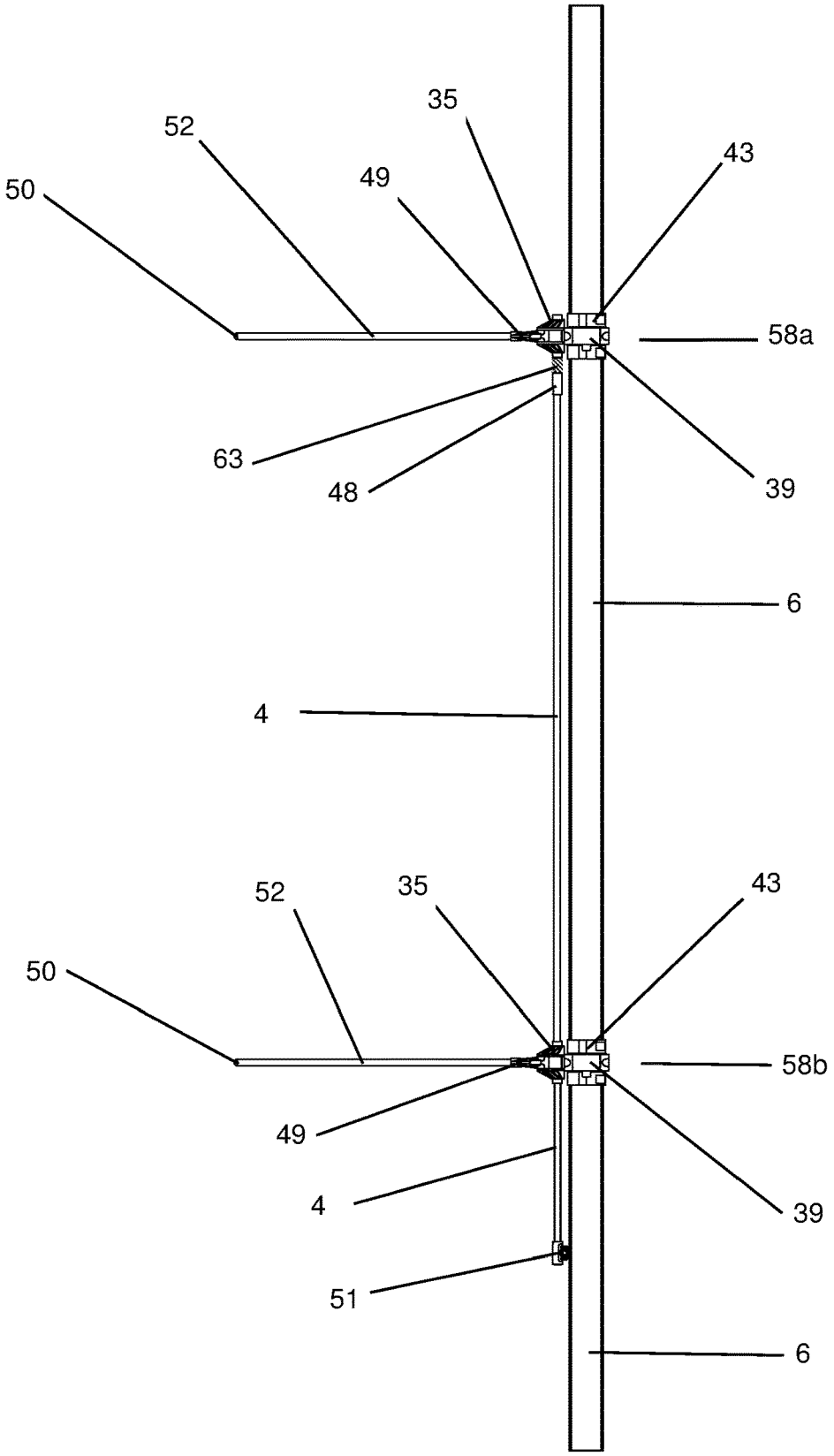
FIG. 16: is a modular pole display assembly coupled with a pole in one embodiment thereof.

Referring to FIGS. 14-16, in this embodiment a second modular bracket (43*b*) may be secured to said pole below the first modular bracket (43*a*), and may also have one or more modular insert positions (44). A second modular flag insert (35) may be secured to a second modular bracket (43*b*) forming a second modular assembly (58*b*). At least one rod coupler (15) on the second modular flag insert (35) may be coupled with a flexible extension connector (48) joining the first and second modular assemblies. In a preferred embodiment, a rod coupler (15) on the second modular flag insert (35) may be coupled with a flexible extension connector (48) directly, or in alternative embodiments, a rod coupler on the second modular flag insert (35) may be coupled with an installation rod (4) that is coupled with the flexible extension connector (48). Again, referring to FIGS. 14-16, a second stem connector (49) may be coupled, in some cases flexibly or statically, with a modular flag insert (35).

As shown in FIG. 14, in this preferred embodiment a display flag (5) may be coupled with the flexible extension connector (48), or corresponding installation rod (4) and said first and said second stem connectors (43). Additional embodiments may include a plurality of display flags (5) being coupled with the first and second modular assemblies (58*a*, 58*b*). For example, in FIGS. 14 and 35B, at least four display flags (5) may be coupled, in this embodiment at approximately right angles to one another, with the first and second modular assemblies (58*a*, 58*b*). Additional embodiments may further include a plurality of modular pole flag display assemblies (62) coupled in series along the length of a pole or other structure, each having a single or even plurality of display flags (5) or other displays. In this embodiment, a plurality of flags may form a larger advertising or marketing display. For example, each display flag (5) may contain a distinct letter or design that may identify or be specific to a marketing event or company.

As demonstrated in FIG. 16, in a preferred embodiment, an installation rod (4) may be coupled with the second modular flag insert (35) supporting the second modular assembly (58*b*), and may further be coupled with a rod base support (51) that may be secured to the pole (6) supporting the coupled components on the pole. In this embodiment, the position of the modular assemblies may be determined by the length of the installation rod (4), as well as the position of the rod base support (51) which may be secured to the on the pole (6). In this configuration it may be possible to configure and couple both first and second modular assemblies (58*a*, 58*b*) to the pole (6) at the bottom of the pole and then couple one or more installation rods (4), which may in some instances be coupled with a flexible extension connector (48), to the second modular assembly (58*b*), for example through a rod coupler (15) on the second modular flag insert (35) and then elevate the coupled assemblies to a desired height on the pole (6) and then secure the installation rod with the rod base support (51) which may then be secured to the pole (6).

Figure 27:
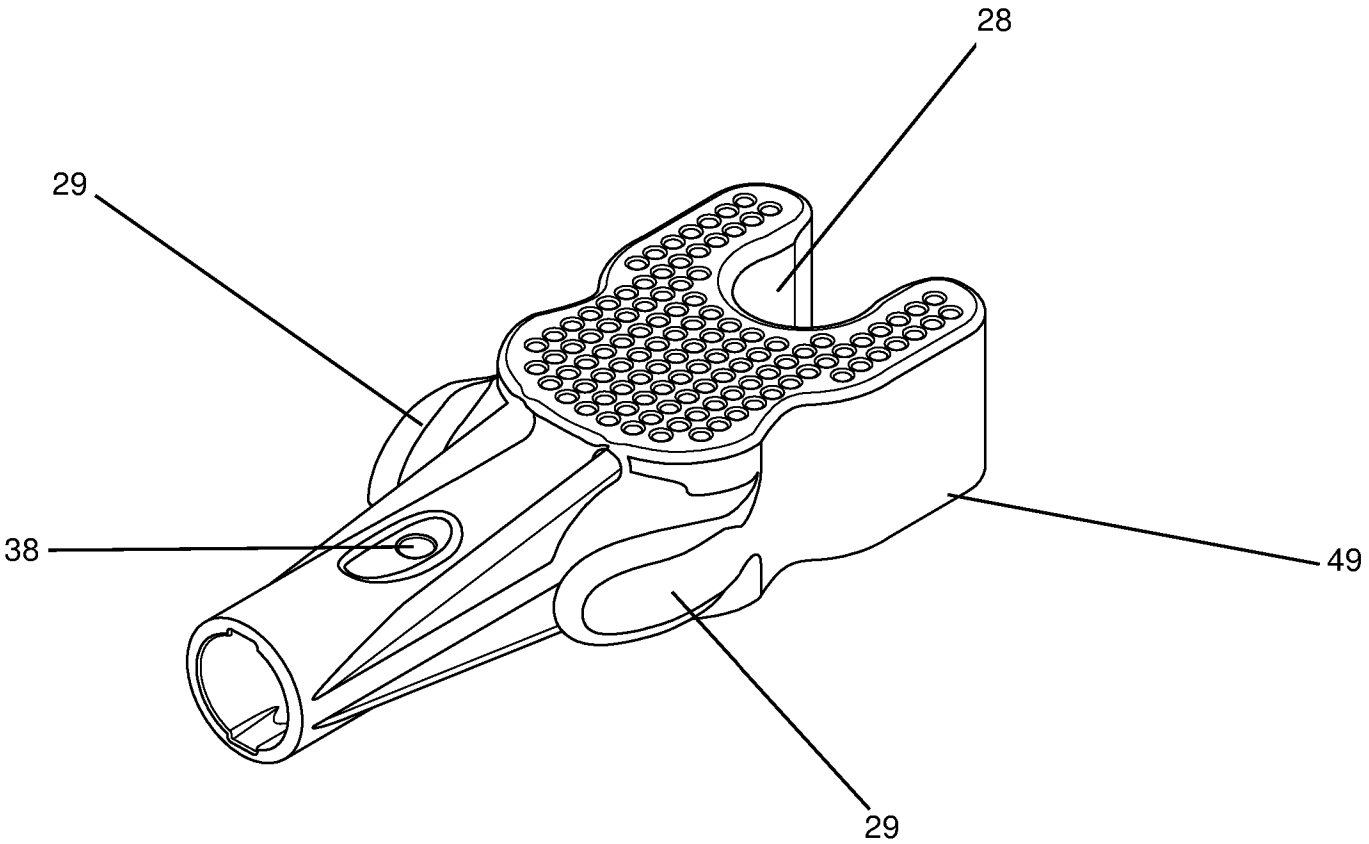
FIG. 27: is a perspective view of a stem connector in one embodiment thereof.

Referring to FIG. 34A, the inventive technology may also include a method of assembling a modular flag display. In this embodiment, a first modular bracket (43*a*), having one or more modular insert positions (44) may be secured to a pole (6). A first modular flag insert (35) may be coupled with the first modular bracket (43*a*) forming a first modular assembly (58*a*). A first stem connector (49), such as the one generally described in FIG. 27, may be coupled with the first modular flag insert (35) and connecting a flexible extension connector (48) may be coupled with a first modular assembly (58*a*) through a rod coupler (15) on the first modular flag insert (35). Next, a first stem connector (49), in this embodiment having an integral stem (52), may be inserted into a top edge flag guide (59) of a display flag (5), and while bending outward from the pole (6) the flexible extension connector (48) and inserting it into a side leading flag guide (60) of a display flag (5). It should be noted that in additional embodiments, a separate stem (52) may be coupled with a first stem connector (49) and then inserted into a top edge flag guide (59) of a display flag (5).

Generally referring to FIGS. 34A-G, in this embodiment, a second modular bracket (43*b*), having one or more modular insert positions (44) may be secured to a pole (6) below the first modular bracket (43*a*). A second modular flag insert (35) may be coupled with the second modular bracket (43*b*) forming a second modular assembly (58*b*). A second stem connector (49), in this case having a detachable stem (52), while in other it may not be detachable, may be coupled with the second modular flag insert (35) and connected by a flexible extension connector (48) to the first modular assembly (58*a*). In this embodiment, this coupling may be made through a rod coupler (15) on the second modular flag insert (35). Next, the display flag (5) may be positioned so the bottom edge flag guide (61) may be approximately in-line with the second stem connector (49) such that the detachable stem (52) may be inserted into the bottom edge flag guide (61) and then coupled with the second stem connector (49). Further, the flexible extension connector (48) may be coupled with the second modular assembly (58*b*) joining both the first and second modular assemblies (58*a*, 58*b*). This coupling may be through a rod coupler (15) on the second modular flag insert (35)—or the second modular bracket (35) or other component—being coupled with a flexible extension connector (48) directly, or with an installation rod (4) coupled with a flexible extension connector (48).

Again, referring to FIG. 34F-G, in this embodiment, a rod base support (51) may be secured to a pole in a position under the second modular assembly (58*b*), for example through one or more band clamps (11). In this configuration, an installation pole or rod (4) (the terms being generally interchangeable) may be coupled with the second modular assembly (58*b*), for example through a rod coupler on the second modular flag insert (35) or other component. The joined first and second modular assemblies (58*a*, 58*b*) may be elevated to a desired position along the length of a pole (6). When established at the desired elevation, the installation pole (4) may be coupled with the rod base support (51) securing in place, and support the modular pole flag display assembly (62). Such steps may be accomplished to configure a plurality of display flags (5) on one or more modular pole flag display assembly (62) singularly, or positioned in series along the length of a pole (6).

Additional embodiments may include rotatable modular brackets. In this embodiment, a modular bracket (43) may freely rotate around a pole or other structure. In certain embodiments, this may be accomplished by the placement of bearings or rollers on the internal surface of a modular bracket (43) such that, for example in response to wind energy, a modular display assembly (34) or modular pole flag display assembly (62) may freely rotate in response. Additional embodiments may include end-caps that may be placed over the terminal end of a stem (52) and may include a securement element, such as a hook, clasp, tie, extension or flared protrusion to secure a display, such as a flag or advertisement in place.

Generally referring now to FIGS. 38 A and B, in one embodiment the inventive technology may include one or more circular pole mounts (68). In this preferred embodiment, a circular pole mount (68) may be coupled with a circular pole (6) or other surface or structure. In this embodiment, the circular pole mount (68) may be formed by a plurality of circular pole mount (68) components that may be positioned over a pole and, in this embodiment secured into a static position. Additional embodiments may include a circular pole mount (68) that may include a hinged such that it may be clamped over a pole (6). In either embodiment described above, it may be that the circular pole mount (68) may be further secured to a desired position on a pole. In this embodiment, for example, one or more circular pole mounts (68) may be permanently, or even semi-permanent attached to a position along a pole (6). This may be accomplished in some cases through a fitted or frictional attachment between the pole (6) and the circular pole mount (68). Additional embodiments may include securement components such as screws, catches, bolts and the like.

Figure 38A:
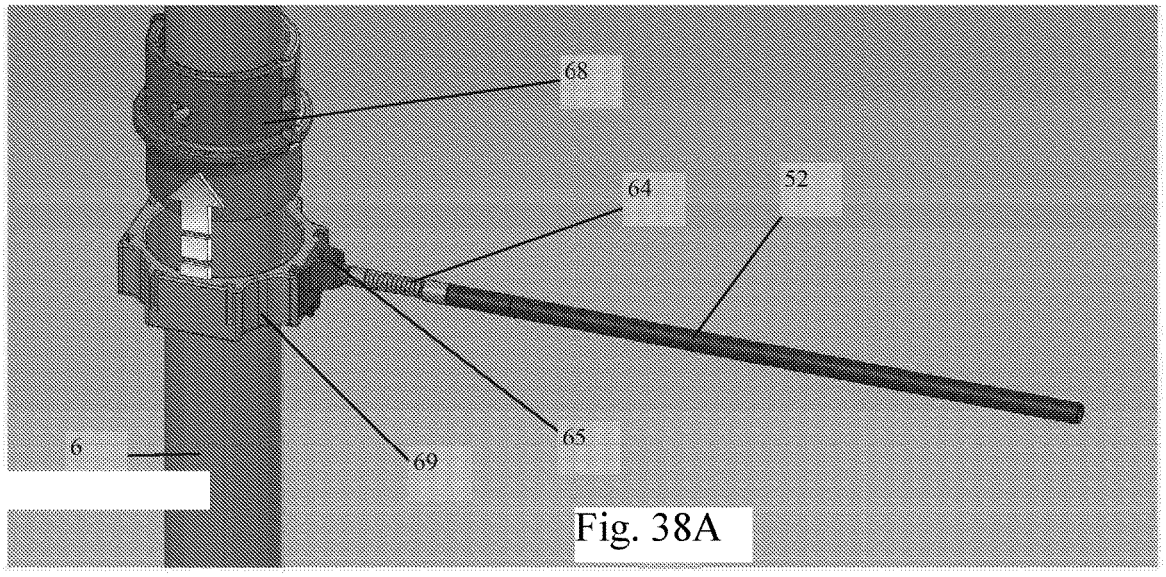
FIG. 38A: a circular pole mount coupled with a modular circular pole bracket in one embodiment thereof.
Figure 38B:
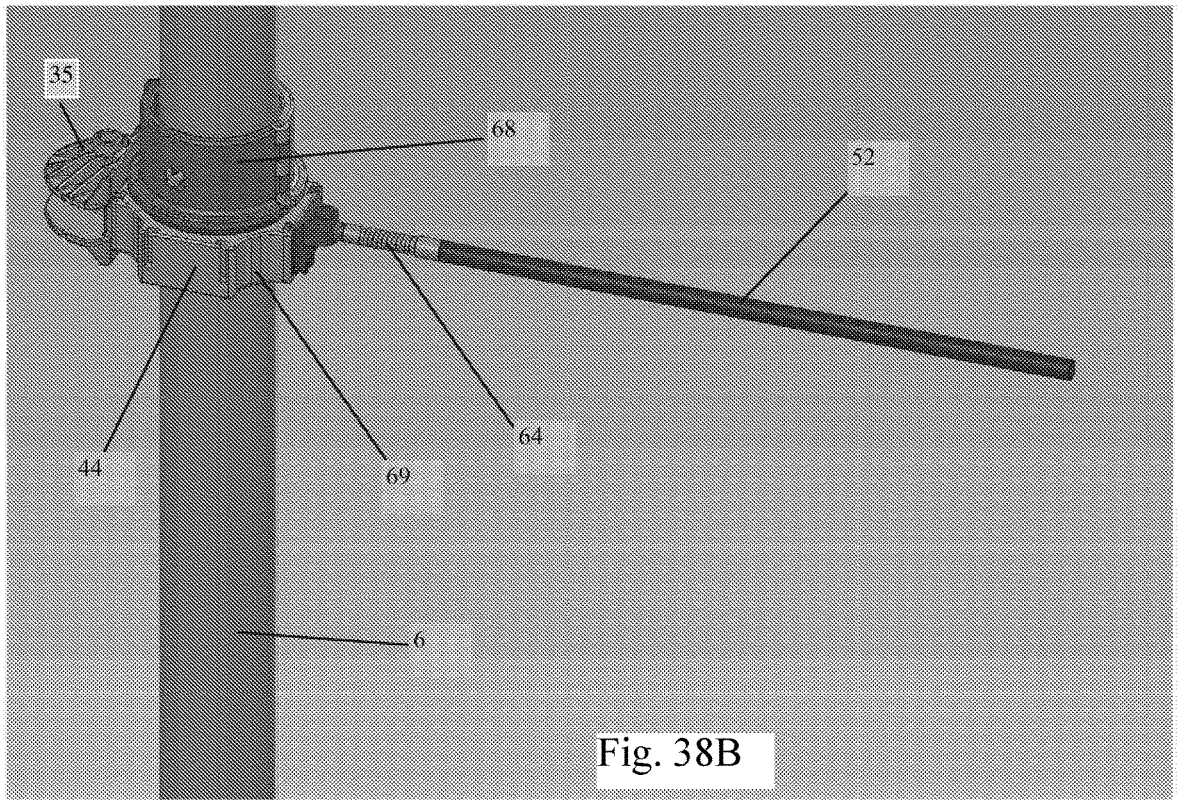
FIG. 38B: a circular pole mount coupled with a modular circular pole bracket in one embodiment thereof.

As shown in FIG. 38 A-B, in this embodiment a modular circular pole bracket (69) maybe placed over a pole and coupled with a circular pole mount (68). In this preferred embodiment, a circular pole bracket (69) may be may be formed by a plurality of circular pole bracket (69) components that may be positioned over a pole, while in other embodiments, a circular pole bracket (69) may be hinged such that it may be able to be clamped around, in this case a circular pole (6) or other surface or structure. Again, as shown in FIGS. 38A-B, in this embodiment a circular pole bracket (69) may be coupled with a circular pole mount (68) through a fitted or frictional attachment. Additional embodiments may include a lock that may secure the circular pole bracket (69) to the circular pole mount (68). In some embodiments, this locking attachment may be static, while in other embodiments it may be dynamic, such that the circular pole bracket (69) may rotate around the stationary circular pole mount (68). In one embodiment, a circular pole bracket (69) and circular pole mount (68) may be coupled through a railed connection allowing rotation of the circular pole bracket (69) around the circular pole mount (68).

In one preferred embodiment, a circular pole bracket (69) may include one or more modular insert positions (44) that may be coupled with, for example an insert, such as a modular flag insert (35) or stem coupler insert (65) or a combination of the same. In another preferred embodiment, a first circular pole mount (68) may be coupled to a pole (6) (or other surface or structure) and further coupled with a first circular pole bracket (69) forming a first assembly. A second circular pole mount (68) may be coupled to the same pole (6) (or other surface or structure) and further coupled with a second circular pole bracket (69) forming a second assembly. Both the first and second circular pole brackets (69) may secure one or more inserts, such as a modular flag insert (35) or stem coupler insert (65) or a combination of the same. In a preferred embodiment, both the first and second assemblies may be coupled together. In this embodiment, a flexible extension connector (48), an installation pole (4), or a flexible extension connector (48) coupled with one or more an installation poles (4) may secure both the first and second assemblies. In a preferred embodiment, a flexible extension connector (48) coupled with one or more installation poles (4) may be coupled with rod couplers (15) on, in this embodiment a stem coupler insert (65) or other inserts as generally described herein. Additional embodiments may include a flexible extension connector (48), an installation pole (4), or a flexible extension connector (48) coupled with one or more an installation poles (4) being coupled with rod couplers (15) on a circular pole bracket (69) or even circular pole mount (68).

In one embodiment, a modular pole flag display assembly (62) may include a stem (52) configured to be pliable in multiple directions. Generally referring to FIG. 36A-B, in one preferred embodiment a spring coupler (64) may be coupled with a stem (6). In this embodiment, a spring coupler (64) may include a multi-directional spring, such as a heavy-duty metal spring, that may provide multi-directional movement of a stem (4). In this embodiment, when a display flag (5) is coupled with stems (5) at its top and bottom edges, the natural action of wind energy against the surface area of the display flag (5) may draw the top and bottom stems (5) inward towards the flag's center which may cause downward pressure to be exerted on a modular bracket (43) coupled with pole 96). This pressure may cause the modular bracket (43) to pinch and become stuck against the pole surface. However, in this embodiment the spring coupler (64) may adsorb this inward pressure and thus may relieve the pinching action on, for example, the modular bracket (43).

In certain embodiments, the spring coupler (64) may be biased in an upward direction. As noted above, the natural action of wind energy against the surface area of the display flag (5) may cause the top and bottom stems (5) to be pulled medially toward the flag' centerline which may cause a sagging of the display flag (5). In this embodiment, the spring coupler (64), in this biased configuration, may cause the display flag (5) to be initially in a stretched, or over-compensated position such that the application of wind energy, or the weight of the flag against the surface of the display flag (5) will draw the top and bottom spring couplers (64) into a more perpendicular alignment in relation to the pole (6). In this embodiment, the flag may be maintained in a more aesthetically pleasing stretched position.

Figure 36C:
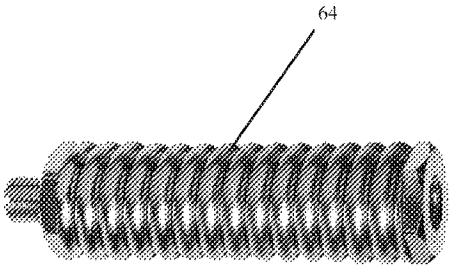
FIG. 36C: is a spring coupler in one embodiment thereof.
Figure 36B:
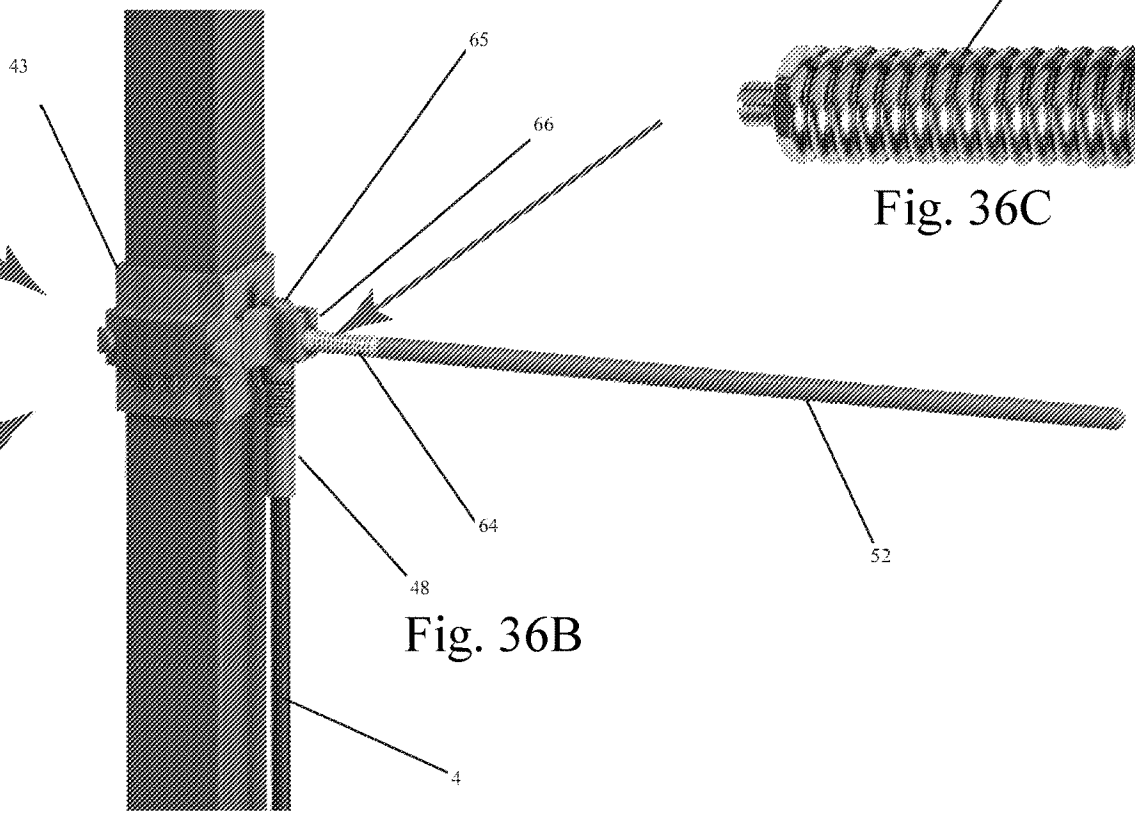
FIG. 36B: a top stem coupler insert coupled with a spring coupler in one embodiment thereof.
Figure 36A:
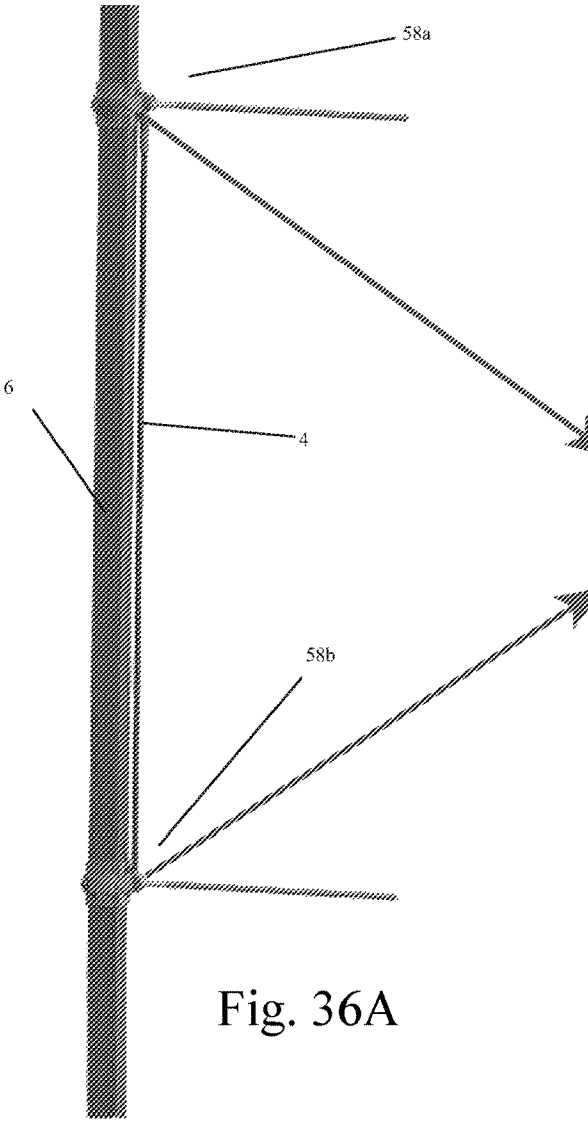
FIG. 36A: a stem coupler insert coupled with a spring coupler in one embodiment thereof.
Figure 37B:
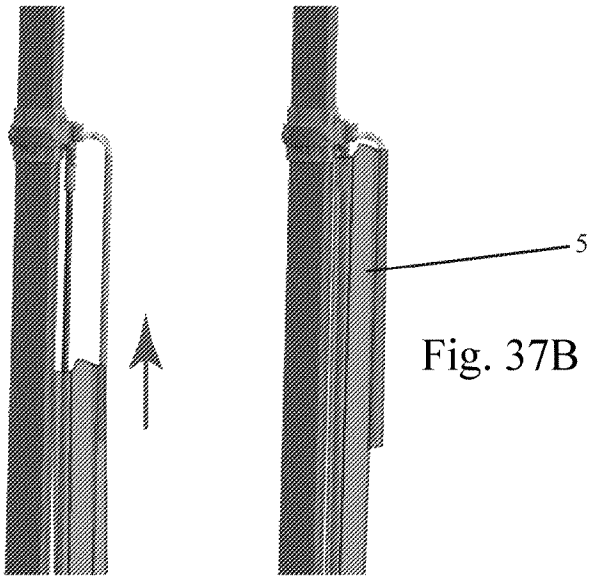
FIG. 37B: is a stepwise method of assembling a modular pole display assembly having a stem coupler insert and spring coupler in one embodiment thereof.
Figure 37D:
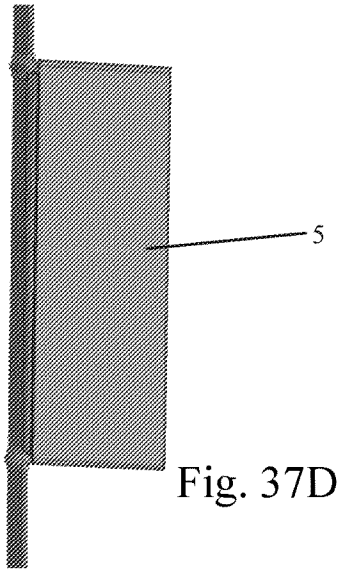
FIG. 37D: is a stepwise method of assembling a modular pole display assembly having a stem coupler insert and spring coupler in one embodiment thereof.
Figure 37A:
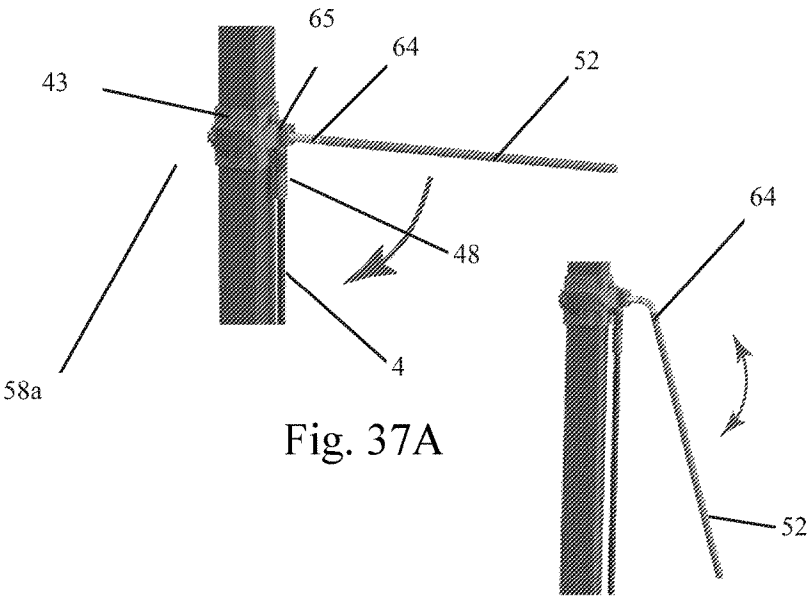
FIG. 37A: is a stepwise method of assembling a modular pole display assembly having a stem coupler insert and spring coupler in one embodiment thereof.
Figure 37C:
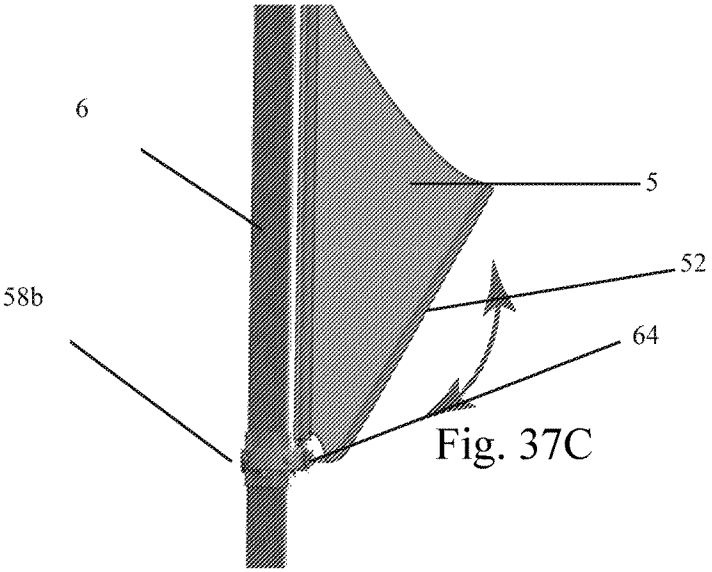
FIG. 37C: is a stepwise method of assembling a modular pole display assembly having a stem coupler insert and spring coupler in one embodiment thereof.

In one preferred embodiment, a spring coupler (64) may form a stem (52). Referring again to FIG. 36, in other embodiments a spring coupler (64) may be coupled with a stem (52) through a stem connector position (67). This stem connector position (67) may include a lock, such as a snap, button or quick release lock mechanism. Again, as shown in FIG. 36, in one embodiment a spring coupler (64) may be coupled with a stem coupler insert (65) which may be secured to a modular bracket (43) as discussed generally herein. In one embodiment, a spring coupler (64) may be secured by a spring support (66) on a stem coupler insert (65), for example through a lock or other securement mechanism. In this preferred embodiment, a spring coupler (64) may be coupled with a washer, such as a threaded metal washer. This metal washer or plate may be inserted into a spring support (66) on a stem coupler insert (65) securing the spring coupler (65) which may be further coupled with a stem (52). In some embodiment, this stem (52) may be made of a rigid plastic/composite or other elastomeric material or a lightweight metal such as aluminum.

Referring to FIG. 37A-D, the inventive technology may also include a method of assembling a modular flag display at ground level. In this embodiment, a first modular bracket (43), having one or more modular insert positions (44) may be secured to a pole (6). A first stem coupler insert (65) may be coupled with the first modular bracket (43) forming a first modular assembly (58*a*). A first spring coupler (64) may be coupled with the first stem coupler insert (65) and further coupled with a stem (52). A flexible extension connector (48) may be coupled with a first modular assembly (58*a*) through a rod coupler (15) on the first stem coupler insert (65) or elsewhere. Next, the stem (52), coupled with the spring coupler (64) may be bent downward and inserted into a top edge flag guide (59) of a display flag (5), and while bending towards the pole (6) the flexible extension connector (48) may be inserting it into a side leading flag guide (60) of a display flag (5).

Generally referring to FIGS. 37A-D, in this embodiment, a second modular bracket (43), having one or more modular insert positions (44) may be secured to a pole (6) below the first modular bracket (43). A second stem coupler insert (65) may be coupled with the second modular bracket (43) forming a second modular assembly (58*b*). A second spring coupler (64), in this case having a detachable stem (52), may be coupled with the second stem coupler insert (65). Next, second spring coupler (64) coupled with a stem (52) may be bent upward and positioned to be in-line with the bottom edge flag guide (61) of the display flag (5) such that the stem (52) may be inserted into the bottom edge flag guide (61). Further, the flexible extension connector (48) may be coupled with the second modular assembly (58*b*) joining both the first and second modular assemblies (58*a*, 58*b*). This coupling may be through a rod coupler (15) on the second modular flag insert (35)—or the second modular bracket (35) or other component—being coupled with a flexible extension connector (48) directly, or with an installation rod (4) coupled with a flexible extension connector (48).

In this embodiment, a rod base support (51) may be secured to a pole (6) in a position under the second modular assembly (58*b*), for example through one or more band clamps (11). In this configuration, an installation pole or rod (4) (the terms being generally interchangeable) may be coupled with the second modular assembly (58*b*), for example through a rod coupler on the second stem coupler insert (65) or other component. The joined first and second modular assemblies (58*a*, 58*b*) may be elevated to a desired position along the length of a pole (6). When established at the desired elevation, the installation pole (4) may be coupled with the rod base support (51) securing in place, and support the modular pole flag display assembly (62). Such steps may be accomplished to configure a plurality of display flags (5) on one or more modular pole flag display assembly (62) singularly, or positioned in series along the length of a pole (6).

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, techniques as well as devices to accomplish a Modular pole display assembly and the like. In this application, the methods and apparatus for the aforementioned systems are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

While the invention has been described in connection with one or more preferred embodiment, it is not intended to limit the scope of the invention to the particular form set forth, but on the contrary, it is intended to cover such alternatives, modifications, and equivalents as may be included within the spirit and scope of the invention as defined by the statements of invention. As can be easily understood from the foregoing, the basic concepts of the present invention may be embodied in a variety of ways. It involves both techniques as well as devices to accomplish the appropriate system. In this application, the techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention may be described in some instances in method-oriented terminology, each element of the claims corresponds to a device and vice versa. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling method and/or technique, and/or device." Such changes and alternative terms are to be understood to be explicitly included in the description.

Any patents, publications, or other references mentioned in this application for patent, such as in the specification or an IDS are hereby incorporated herein by reference in their entirety. Any priority case(s) claimed by this application is hereby appended and hereby incorporated herein by reference in their entirety. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated herein by reference in their entirety. Finally, all references listed in the list of References To Be Incorporated By Reference In Accordance With The Patent Application or other information disclosure statement and the like filed with the application are hereby appended and hereby incorporated herein by reference in their entirety, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the methods and/or apparatus for providing an modular pole display assembly as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this application also provides support for any combination of elements in the claims and even incorporates any desired proper antecedent basis for certain claim combinations such as with combinations of method, apparatus, process, and the like claims.

Any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The inventive subject matter is to include, but certainly not be limited as, a system substantially as herein described with reference to any one or more of the Figures and Description (including the following: for example, the process according to any claims and further comprising any of the steps as shown in any Figures, separately, in any combination or permutation).

Finally, Applicant reserves the right to seek additional design patent protection over the claimed invention, such that the drawings are fully enabled so as to allow one of ordinary skill in the art to know that the claimed design was in Applicant's possession at the time of filing. As such, it should be noted that any broken lines are to be included for the purpose of illustrating environmental matter and form no part of the claimed design should such become necessary.

What is claimed is:

1. A modular pole flag display assembly comprising:

a first modular bracket configured to be slidably secured to a pole wherein said first modular bracket has one or more modular insert positions;

a first stem coupler insert configured to be secured to said first modular bracket forming a first modular assembly;

at least one rod coupler on said first stem coupler insert configured to be coupled with a flexible extension connector;

a first spring coupler configured to be coupled with said first stem coupler insert;

a second modular bracket configured to be slidably secured to said pole wherein said first modular bracket has one or more modular insert positions;

a second stem coupler insert configured to be secured to said second modular bracket forming a second modular assembly;

at least one rod coupler on said second stem coupler insert configured to be coupled with another flexible extension connector;

a second spring coupler coupled with said second stem coupler insert; and at least one display flag coupled with an installation rod that is configured to be coupled with at least one of said flexible extension connectors and said first and said second spring couplers.

2. A modular pole flag display assembly as described in claim 1 wherein said modular brackets comprise modular brackets having a first and second modular bracket component configured to interlock with one another around a pole.

3. A modular display assembly as described in claim 2 wherein said first and second modular bracket components are configured to interlock with one another around a pole and further be secured by at least one modular insert.

4. A modular pole flag display assembly as described in claim 1 wherein said pole comprises a circular pole.

5. A modular pole flag display assembly as described in claim 1 wherein said one or more modular insert positions comprise modular insert positions having at least one bracket adaptor.

6. A modular pole flag display assembly as described in claim 5 wherein said stem coupler inserts comprises stem coupler inserts having at least one insert adaptor configured to be coupled with said bracket adaptor.

7. A modular pole flag display assembly as described in claim 1 wherein said one or more modular insert positions comprise one or more modular insert positions having at least one insert catch.

8. A modular pole flag display assembly as described in claim 6 wherein said stem coupler inserts comprise stem coupler inserts having at least one insert latch configured to be coupled with said insert catch.

9. A modular pole flag display assembly as described in claim 1 wherein said one or more modular insert positions comprise one or more modular insert positions having at least one lock.

10. A modular pole flag display assembly as described in claim 1 wherein said stem coupler inserts configured to be secured to said modular brackets forming a modular assembly comprises a plurality of stem coupler inserts configured to be secured to each of said modular brackets.

11. A modular pole flag display assembly as described in claim 1 further comprising one or more modular inserts configured to be secured to said one or more modular insert positions on said modular brackets.

12. A modular pole flag display assembly as described in claim 11 wherein said modular inserts comprise modular inserts selected from the group consisting of: modular display inserts; modular balloon inserts; stem coupler insert and modular blank inserts.

13. A modular pole flag display assembly as described in claim 1 wherein said rod couplers comprises rod couplers having a coupler lock.

14. A modular pole flag display assembly as described in claim 1 wherein said flexible extension connector comprises flexible extension connector configured to be secured by a coupler lock.

15. A modular pole flag display assembly as described in claim 1 and further comprising a stem configured to be secured to said first spring coupler and a stem configured to be secured to said second spring coupler.

16. A modular pole flag display assembly as described in claim 15 wherein said first and second spring couplers are coupled with said first and second stem coupler inserts through spring supports.

17. A modular pole flag display assembly as described in claim 1 further comprising at least one installation rod configured to be coupled with said second modular assembly positioned below and coupled with said first modular assembly.

18. A modular pole flag display assembly as described in claim 17 further comprising at least one rod base support configured to be secured to said pole and said installation rod coupled with said second modular assembly positioned below and coupled with said first modular assembly.

19. A modular pole flag display assembly as described in claim 18 wherein said rod base support comprises rod base support having:

an external attachment surface;

at least one band apertures;

at least one band clamp configured to be positioned through said band aperture and secure said rod base support to said pole; and at least one rod coupler configured to secure at least one installation pole.

20. A modular pole flag display assembly as described in claim 18 wherein said rod base support comprises a rod base support selected from the group consisting of: a rod base support having a magnet external attachment surface; and a rod base support having an adhesive external attachment surface.

* * * * *